US011807485B2

(12) United States Patent
Aoki et al.

(10) Patent No.: US 11,807,485 B2
(45) Date of Patent: Nov. 7, 2023

(54) SHEET FEEDING APPARATUS, CONTROL METHOD OF THE SAME, AND NON-TRANSITORY COMPUTER STORAGE MEDIUM STORING CONTROL PROGRAM OF THE SAME

(71) Applicant: Horizon Inc., Takashima (JP)

(72) Inventors: Eiji Aoki, Takashima (JP); Tomonori Yachi, Takashima (JP); Hiromasa Nambu, Takashima (JP)

(73) Assignee: Horizon Inc., Takashima (JP)

( * ) Notice: Subject to any disclaimer, the term of this patent is extended or adjusted under 35 U.S.C. 154(b) by 99 days.

(21) Appl. No.: 17/468,299

(22) Filed: Sep. 7, 2021

(65) Prior Publication Data

US 2022/0073297 A1 Mar. 10, 2022

(30) Foreign Application Priority Data

Sep. 8, 2020 (JP) ..... 2020-150840
Jul. 19, 2021 (JP) ..... 2021-118777

(51) Int. Cl.
*B65H 3/12* (2006.01)
*B65H 3/52* (2006.01)
(Continued)

(52) U.S. Cl.
CPC ..... *B65H 3/124* (2013.01); *B65H 3/5207* (2013.01); *B65H 3/68* (2013.01); *B65H 7/16* (2013.01);
(Continued)

(58) Field of Classification Search
CPC . B65H 1/04; B65H 1/06; B65H 3/042; B65H 3/047; B65H 3/12; B65H 3/122;
(Continued)

(56) References Cited

U.S. PATENT DOCUMENTS 5,150,892 A * 9/1992 Shimizu ..... B65H 3/48 271/106
5,464,202 A 11/1995 Capdeboseq
(Continued)

FOREIGN PATENT DOCUMENTS

JP 58036838 A * 3/1983 ..... B65H 3/12
JP 2001-097563 A 4/2001
WO WO 2014/006747 A1 1/2014

OTHER PUBLICATIONS

Extended European Search Report for European Application No. 21195121.5 dated Feb. 7, 2022.

*Primary Examiner* — Prasad V Gokhale
(74) *Attorney, Agent, or Firm* — Muncy, Geissler, Olds & Lowe, P.C.

(57) ABSTRACT

Perforated endless conveying belts are stretched between drive and idle rollers. A suction box is arranged between upper and lower belt portions of the perforated endless conveying belts. Abutment members are attached to positions of a support corresponding to the perforated endless conveying belts and pressed against the perforated endless conveying belts. The upstream of the suction box from the abutment members forms an attracting area, and intake holes are formed therein. Lifting plates extend to at least an intake hole range of the attracting area between the perforated endless conveying belts. The lifting plates move between a first position to vertically open the intake holes and project from conveying surfaces of the perforated endless conveying belts and a second position to close the intake holes and retract from the conveying surfaces of the perforated endless conveying belts.

16 Claims, 14 Drawing Sheets

(51) Int. Cl.
*B65H 3/68* (2006.01)
*B65H 7/16* (2006.01)
*B65H 11/00* (2006.01)

(52) U.S. Cl.
CPC .... *B65H 11/002* (2013.01); *B65H 2406/3221* (2013.01); *B65H 2557/33* (2013.01)

(58) Field of Classification Search
CPC ..... B65H 3/124; B65H 3/126; B65H 3/128; B65H 3/34; B65H 3/46; B65H 3/52; B65H 3/5207; B65H 3/5215; B65H 3/68; B65H 7/16; B65H 11/002; B65H 11/005; B65H 11/007; B65H 2406/32; B65H 2406/321; B65H 2406/3221; B65H 2406/3222; B65H 2406/362; B65H 2406/3622; B65H 2406/363
See application file for complete search history.

(56) References Cited

U.S. PATENT DOCUMENTS

| | | | | |
|---|---|---|---|---|
| 10,683,180 | B2 | 6/2020 | Serra Obiols et al. | |
| 2006/0290048 | A1 | 12/2006 | Dobashi | |
| 2011/0248441 | A1* | 10/2011 | Yamada | B41J 11/06 271/11 |
| 2015/0170349 | A1 | 6/2015 | Mochizuki et al. | |
| 2020/0307931 | A1* | 10/2020 | Hori | B65H 3/46 |

* cited by examiner

SHEET FEEDING APPARATUS, CONTROL METHOD OF THE SAME, AND NON-TRANSITORY COMPUTER STORAGE MEDIUM STORING CONTROL PROGRAM OF THE SAME

CROSS-REFERENCE TO RELATED APPLICATIONS

This application claims priority to Japanese Patent Application No. 2020-150840 filed Sep. 8, 2020, and Japanese Patent Application No. 2021-118777 filed Jul. 19, 2021, the contents of which are incorporated herein by reference in its entirety.

BACKGROUND

1. Technical Field

The present disclosure relates to a sheet feeding apparatus a so-called top feed system (a system to sequentially supply the uppermost sheet from a sheet stack) or bottom feed system (a system to sequentially supply the lowermost sheet from a sheet stack), a control method of the sheet feeding apparatus, and a non-transitory computer readable storage medium storing a control program of the sheet feeding apparatus.

2. Description of Related Art

A sheet feeding apparatus disclosed in International Publication No. 2014/006747 is an example of the conventional sheet feeding apparatuses of the top feed system. The sheet feeding apparatus disclosed in International Publication No. 2014/006747 has a vertically movable sheet placement stage on which a sheet stack is placed, an alignment plate arranged near the front of the sheet placement stage and facing the front end face of a sheet stack on the sheet placement stage, and a conveyance unit arranged above the uppermost sheet of the sheet stack on the sheet placement stage so as to face the uppermost sheet and configured to attract the uppermost sheet and feed forward the uppermost sheet beyond the alignment plate while the sheet placement stage gradually rises.

The conveyance unit has a drive roller and an idle roller horizontally arranged spaced apart from each other in a sheet conveyance direction above the sheet placement stage and each extending orthogonally to the conveyance direction, a perforated endless conveying belt extended between the drive roller and the idle roller, a suction box arranged between the upper and lower belt portions of the perforated endless conveying belt and having a plurality of intake holes formed in the underside, and a suction unit configured to produce a negative pressure in the internal space of the suction box.

The suction unit is formed of a suction pump, an intake pipe connected between the suction box and the suction pump, and a solenoid valve arranged in the intake pipe, and attraction and release of attraction by the suction box is switched by opening and closure of the solenoid valve.

In this arrangement, during operation of the sheet feeding apparatus, the perforated endless conveying belt is revolved, and the solenoid valve is opened and closed at predetermined timings.

Further, the alignment plate is provided with an air blow-off unit. Further, during operation of the sheet feeding apparatus, air is always blown from the air blow-off unit to the upper layer of the sheet stack on the sheet placement stage, and sheets in the upper layer of the sheet stack float from the sheet stack while being separated from each other.

In such a way, during operation of the sheet feeding apparatus, the uppermost sheet that has received air and floated is attracted by the suction box and the revolving perforated endless conveying belt and fed forward.

Further, a sheet feeding apparatus disclosed in Japanese Patent Application Laid-Open No. 2001-97563 is an example of the conventional sheet feeding apparatuses of the bottom feed system. The sheet feeding apparatus disclosed in Japanese Patent Application Laid-Open No. 2001-97563 has a sheet accommodation part that accommodates sheets in a stacked state, a bottom feed mechanism that is arranged at the bottom of the sheet accommodation part and sequentially feeds out the lowermost sheet from the sheet stack accommodated in the sheet accommodation part, a retard roll that separates a plurality of sheets fed out in a double feed state from the sheet accommodation part by the bottom feed mechanism and conveys the separated sheets one by one, and a restriction guide slope wall provided on the exit side of the sheet accommodation part and inclined downward from upstream in the sheet feed out direction toward the retard roll.

The leading ends of sheets accommodated in the sheet accommodation part come into contact with the restriction guide slope wall, and this results in a state where the sheets forming a sheet stack are shifted from each other little by little rearward from the bottom sheet.

The restriction guide slope wall is provided with a sliding-in preventing member that prevents a sheet coming into contact therewith from sliding into downward along the slope.

The bottom feed mechanism has a first conveying roll group arranged on the entry side of the sheet accommodation part and rotatable about a shaft extending orthogonally to the feed out direction, a second conveying roll group arranged parallel to the first conveying roll group downstream of the first conveying roll group, a first support roll sharing a rotary shaft with the second conveying roll group, a second support roll arranged near the retard roll, and a conveying belt stretched in a tense state between the first and second support rolls.

The retard roll has a torque limiter and is in contact with the conveying belt on the second support roll of the bottom feed mechanism.

Further, during sheet feeding, the retard roll is in a stopped state due to a braking effect of the torque limiter, and while allowing entry of the lowermost sheet of a plurality of sheets fed out in a double feed state between the retard roll and the rotating conveying belt, prevents entry of the remaining sheets of the plurality of sheets. Then, once the lowermost sheet is interposed between the retard roll and the conveying belt, the retard roll overcomes the braking effect of the torque limiter and starts free rotation, and this causes only the lowermost sheet to be fed forward.

BRIEF SUMMARY

If differences in size, thickness, weight, and the like of sheets range widely, however, it will be difficult to balance countermeasures against double feed and misfeed (sheet feeding failure) of sheets.

Further, setting of separation parameters used for separating sheets one by one in accordance with the size, thickness, weight, and the like of the sheets is complicated work.

Therefore, the object of the present disclosure is to provide a sheet feeding apparatus, a control method of the sheet feeding apparatus, and a non-transitory computer readable storage medium storing a control program of sheet feeding apparatus that can reliably separate and supply sheets one by one from a sheet stack even with a wide range of differences in size, thickness, weight, and the like of sheets.

A sheet feeding apparatus according to one aspect of the present disclosure is a sheet feeding apparatus including: at least one conveying belt that conveys an uppermost or lowermost sheet of a sheet stack placed on a conveying surface in a feed out direction and in which a plurality of airflow holes are formed; a suction unit that is arranged on a back surface side, which is the opposite side of the conveying surface of the conveying belt, and in which a first intake hole that sucks the sheet via the airflow holes is formed; at least one lifting plate that reciprocates between a first position located in a sheet accumulation direction with respect to the conveying surface and a second position located at the same height position as the conveying surface or on the back surface side with respect to the conveying surface, opens a second intake hole, which is different from the first intake hole, formed in the suction unit when the lifting plate is at the first position, and closes the second intake hole when the lifting plate is at the second position; and a control unit that controls movement of the lifting plate, wherein the control unit moves the lifting plate from the second position to the first position when the uppermost or lowermost sheet is being conveyed.

The uppermost or lowermost sheet of a sheet stack is sucked and attracted on the conveying surface of the conveying belt from the first intake hole of the suction unit via airflow holes. A sheet is conveyed in a state of being attracted on the conveying surface in such a way. Further, during conveyance of the uppermost or lowermost sheet, the lifting plate is moved from the second position to the first position. Accordingly, a sheet is separated from the conveying surface of the conveying belt by the lifting plate, and the second intake hole that has been closed by the lifting plate is opened. Separation of the sheet from the conveying surface of the conveying belt causes a change in the height position to occur between the lifting plate and the conveying surface and deforms the sheet, and this facilitates separation of a sheet being conveyed from the next sheet overlapped on the sheet. Further, opening of the second intake hole that has been closed by the lifting plate reduces the suction force from the first intake hole, and therefore reduces the attracting force of a sheet on the conveying surface, which can reduce the conveying force for the next sheet subsequent to the sheet being conveyed.

As described above, sheets can be reliably separated and supplied one by one from a sheet stack regardless of differences in size, thickness, weight, and the like of the sheets.

Furthermore, in the sheet feeding apparatus according to one aspect of the present disclosure, the conveying belt is formed of a plurality of conveying belts, the conveying belts are provided in parallel spaced apart from each other by a predetermined gap in a width direction orthogonal to the feed out direction, the lifting plate is formed of a plurality of lifting plates, and the lifting plates are provided between the conveying belts adjacent each other and/or to a side of the conveying belts.

Because the lifting plate is formed of a plurality of lifting plates and provided between the conveying belts and/or to the side of the conveying belt, a sheet can be stably operated.

Further, since the lifting plates and the conveying belts are provided alternatingly in the width direction, by causing sheets to be corrugated when the lifting plate is positioned at the first position, it is possible to facilitate separation between the sheets.

Furthermore, in the sheet feeding apparatus according to one aspect of the present disclosure, the plurality of conveying belts and the plurality of lifting plates are provided symmetrically about the center of the width direction orthogonal to the feed out direction of the sheet.

Since the conveying belts and the lifting plates are provided symmetrically about the center in the width direction orthogonal to the feed out direction of sheets, a sheet can be accurately conveyed.

Furthermore, the sheet feeding apparatus according to one aspect of the present disclosure includes discharge rollers that grip a leading end of a sheet conveyed from the conveying belt and discharge the sheet, and the control unit moves the lifting plate from the second position to the first position when the discharge rollers grip a leading end of a sheet conveyed from the conveying belt.

Once the leading end of a sheet is gripped between the discharge rollers, this results in that the sheet is supported by the discharge rollers, and thus, the movement of the lifting plate less affects the separation between sheets. Therefore, by moving the lifting plate at a timing that the leading end of a sheet is gripped between the discharge rollers, it is possible to more reliably perform the control. For example, it is preferable to provide a sheet detection sensor downstream of the feed out direction of the discharge roller in advance.

Furthermore, in the sheet feeding apparatus according to one aspect of the present disclosure, an abutment member that abuts against the leading end of the sheet is provided upstream from the discharge rollers in the feed out direction.

With the abutment member being provided upstream from the discharge roller in the feed out direction, a sheet stack that is a temporary stack of sheets can be formed upstream of the discharge roller.

Furthermore, in the sheet feeding apparatus according to one aspect of the present disclosure, the conveying belt is formed of a plurality of conveying belts, the conveying belts are provided in parallel spaced apart from each other by a predetermined gap in a width direction orthogonal to the feed out direction, the abutment member is provided between the conveying belts adjacent each other and/or to a side of the conveying belts, and a tip, which is a free end, of the abutment member is formed of an elastic plate-like member that abuts against a sheet.

Since the abutment member is provided between the conveying belts and/or to the side of the conveying belts, the abutment member does not contact with and slide on the conveying belts. This can reduce the wear of the abutment member.

Since the abutment member is an elastic plate-like member and the tip thereof that is a free end abuts against a sheet, the abutment member can bend with elastic force when the tip abuts against the sheet. Accordingly, suitable contact force can be applied to the sheet.

As the elastic abutment member, for example, a rubber is preferably used.

Furthermore, in the sheet feeding apparatus according to one aspect of the present disclosure, at a position facing the tip of the abutment member, a contact surface with which the tip contacts is provided, and the contact surface has the same height as the conveying surface.

Since the contact surface with which the tip of the abutment member contacts is provided and this contact surface has the same height as the conveying surface, the sheet traveling on the conveying surface can be smoothly conveyed without deformation.

Furthermore, the sheet feeding apparatus according to one aspect of the present disclosure includes a guide plate having a slope part that guides a sheet to the tip of the abutment member.

Because the sheet is guided along the slope part of the guide plate, this ensures that the leading end of the sheet can be directed to the tip of the abutment member. Specifically, the slope part is provided such that the distance to the contact surface with which the tip of the abutment member contacts gradually decreases toward the contact member.

The slope part can prevent a sheet from being turned up when the leading end of the sheet comes into contact with the abutment member. Further, even when a turned-up sheet comes in, such turning up can be suppressed by the slope part.

Furthermore, in the sheet feeding apparatus according to one aspect of the present disclosure, the guide plate includes a stopper that has a gap between the abutment member and the stopper and collides with the abutment member when the abutment member is elastically deformed to the guide plate side.

The stopper is provided to the guide plate, and the abutment member collides with the stopper when elastically deformed to the guide plate side. This can restrict excessive deformation of the abutment member. For example, when a sheet is pulled out in a direction opposite to the conveyance direction (pulled out to the guide plate side) in a case of paper jam, the abutment member is also deformed to the guide plate side together with the sheet. The excessive deformation of the abutment member at this time can be suppressed by the stopper.

Furthermore, in the sheet feeding apparatus according to one aspect of the present disclosure, the abutment member is a retard roller provided so as to be pushed against the conveying belt.

Because the abutment member is formed of a retard roller, a sheet can be reliably separated and conveyed.

Furthermore, in the sheet feeding apparatus according to one aspect of the present disclosure, at least one of the lifting plates includes an extension part provided extending to a position corresponding to the abutment part or extending downstream of the abutment part in the feed out direction.

Since at least one of the lifting plates is provided extending to a position corresponding to the retard roller or extending downstream of the retard roller in the feed out direction, a sheet interposed between the retard roller and the conveying belt can be significantly deformed by the lifting plate when the lifting plate is at the first position. Accordingly, the sheet being conveyed and the next sheet subsequent thereto have different shapes, and thereby, the next sheet is less likely to enter the retard roller.

The position corresponding to the retard roller means a position close to (directly under) the retard roller and near the position.

Furthermore, in the sheet feeding apparatus according to one aspect of the present disclosure, the extension part is detachable from the existing lifting plate.

Since the extension part is detachable from the existing lifting plate, the length of the lifting plate can be changed if necessary.

A control method of a sheet feeding apparatus according to one aspect of the present disclosure is a control method comprising a conveying belt that conveys an uppermost or lowermost sheet of a sheet stack placed on a conveying surface in a feed out direction and in which a plurality of airflow holes are formed, a suction unit that is arranged on a back surface side, which is the opposite side of the conveying surface of the conveying belt, and in which a first intake hole that sucks the sheet via the airflow holes is formed, and a lifting plate that reciprocates between a first position located in a sheet accumulation direction with respect to the conveying surface and a second position located at the same height position as the conveying surface or on the back surface side with respect to the conveying surface, opens a second intake hole, which is different from the first intake hole, formed in the suction unit when the lifting plate is at the first position, and closes the second intake hole when the lifting plate is at the second position, the control method comprising: moving the lifting plate from the second position to the first position when the uppermost or lowermost sheet is being conveyed.

A non-transitory computer readable storage medium storing a control program of a sheet feeding apparatus according to one aspect of the present disclosure causes a computer to function as the sheet feeding apparatus described in any of the above.

A sheet can be reliably separated and supplied one by one from a sheet stack even with a wide range of differences in size, thickness, weight, and the like of sheets.

DETAILED DESCRIPTION

First Embodiment

The configuration of the present disclosure will be described below based on preferred embodiments with reference to the attached drawings.

Figure 1A:
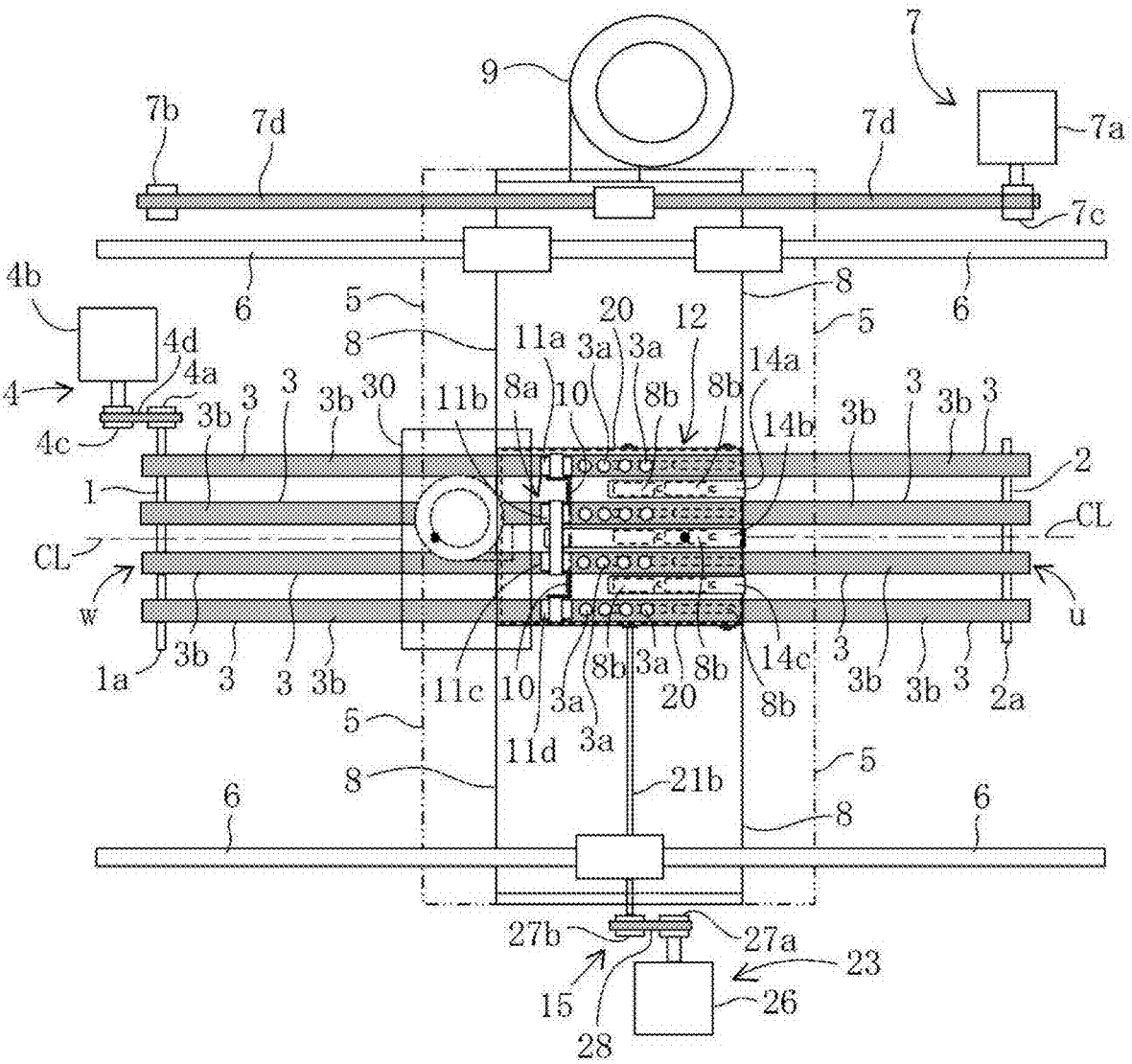
FIG. 1A is a plan view illustrating a schematic diagram of a sheet feeding apparatus according to a first embodiment of the present disclosure.
Figure 1B:
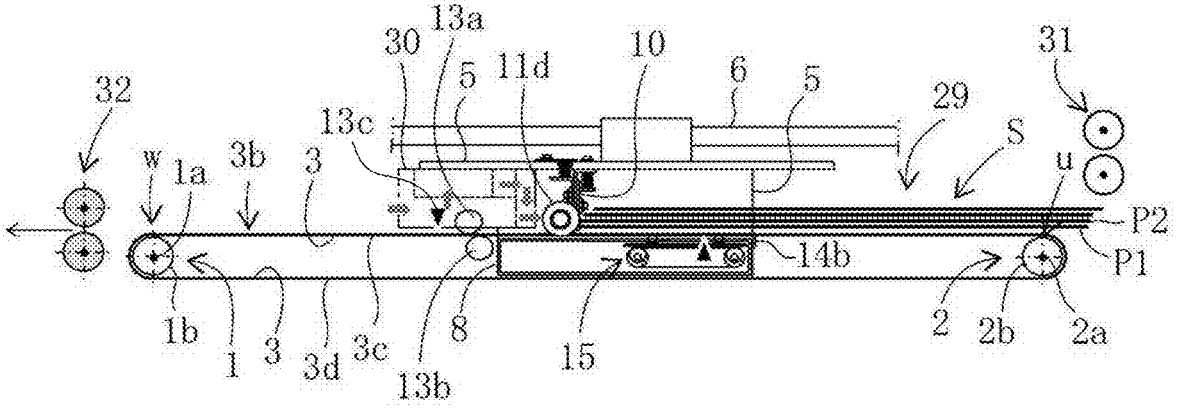
FIG. 1B is a front view illustrating a schematic diagram of a sheet feeding apparatus according to a first embodiment of the present disclosure.

FIGS. 1A and 1B illustrate schematic diagrams of a sheet feeding apparatus according to a first embodiment of the present disclosure, FIG. 1A is a plan view, and FIG. 1B is a font view.

Figure 2:
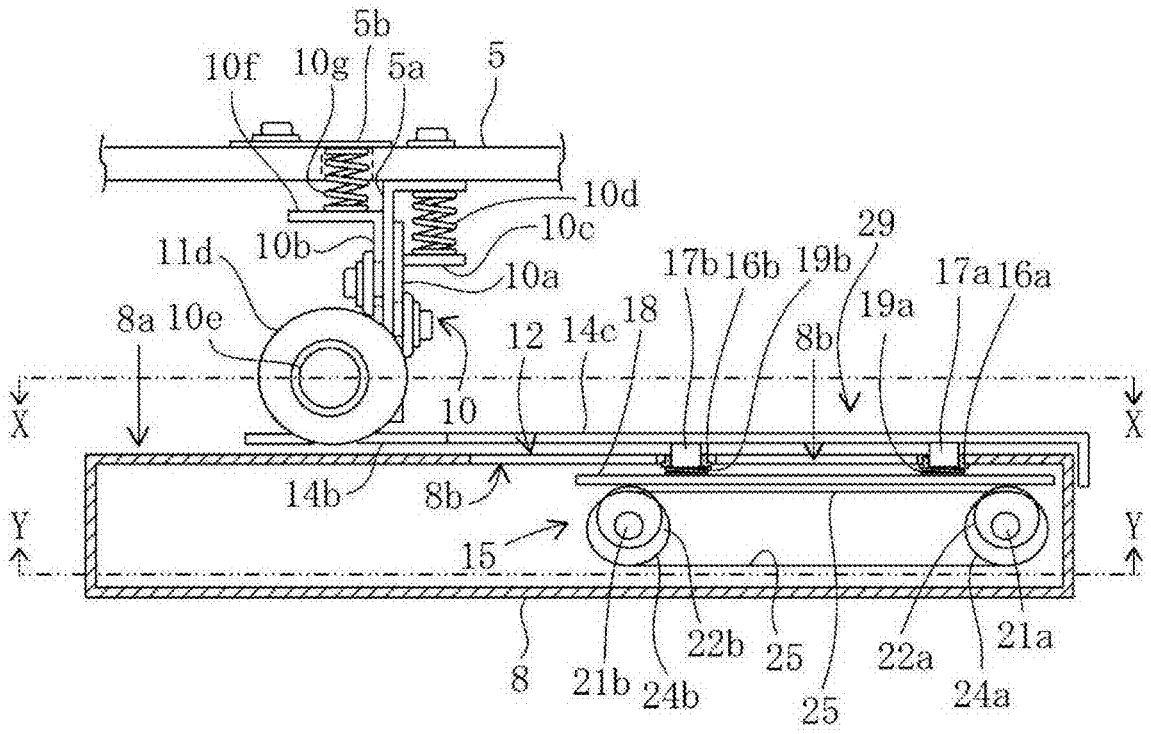
FIG. 2 is an enlarged front view illustrating a suction box and abutment members of the sheet feeding apparatus of FIG. 1 in which the suction box is depicted in a vertically exploded view.

FIG. 2 is an enlarged front view illustrating a suction box and abutment members of the sheet feeding apparatus of FIGS. 1A and 1B in which the suction box is depicted in a vertically exploded view.

Figure 3A:
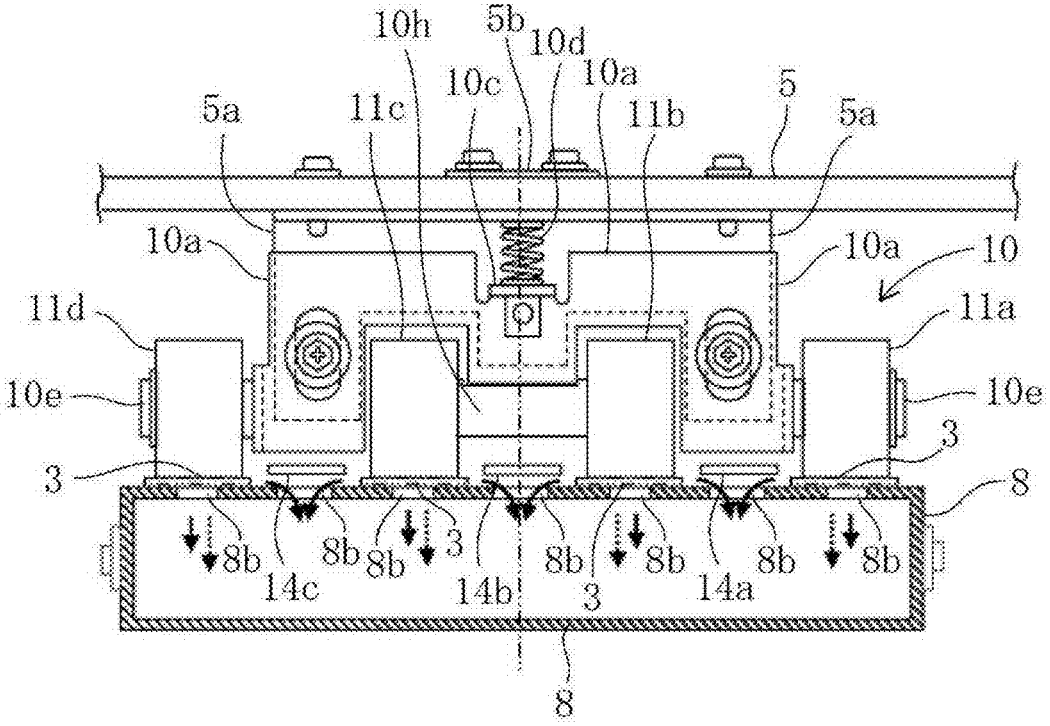
FIG. 3A is a vertical sectional view taken along a direction across the feed out direction when viewed from the upstream of the feed out direction of FIG. 2.
Figure 3B:
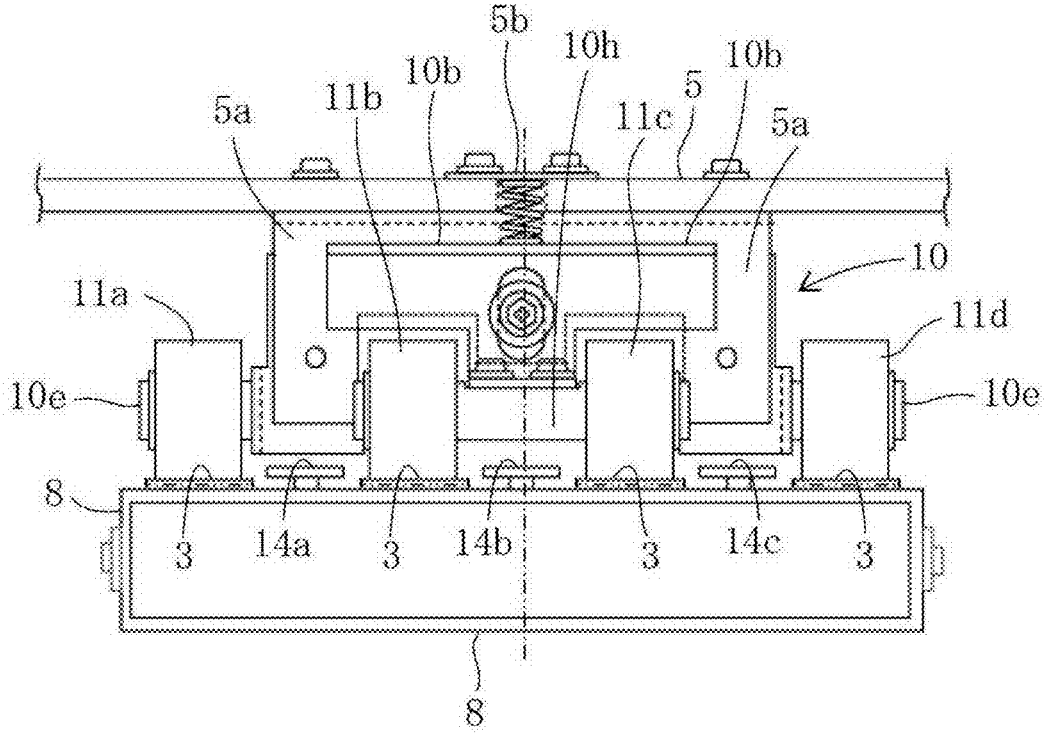
FIG. 3B is a side view when viewed from the downstream of the feed out direction of FIG. 2.
Figure 4A:
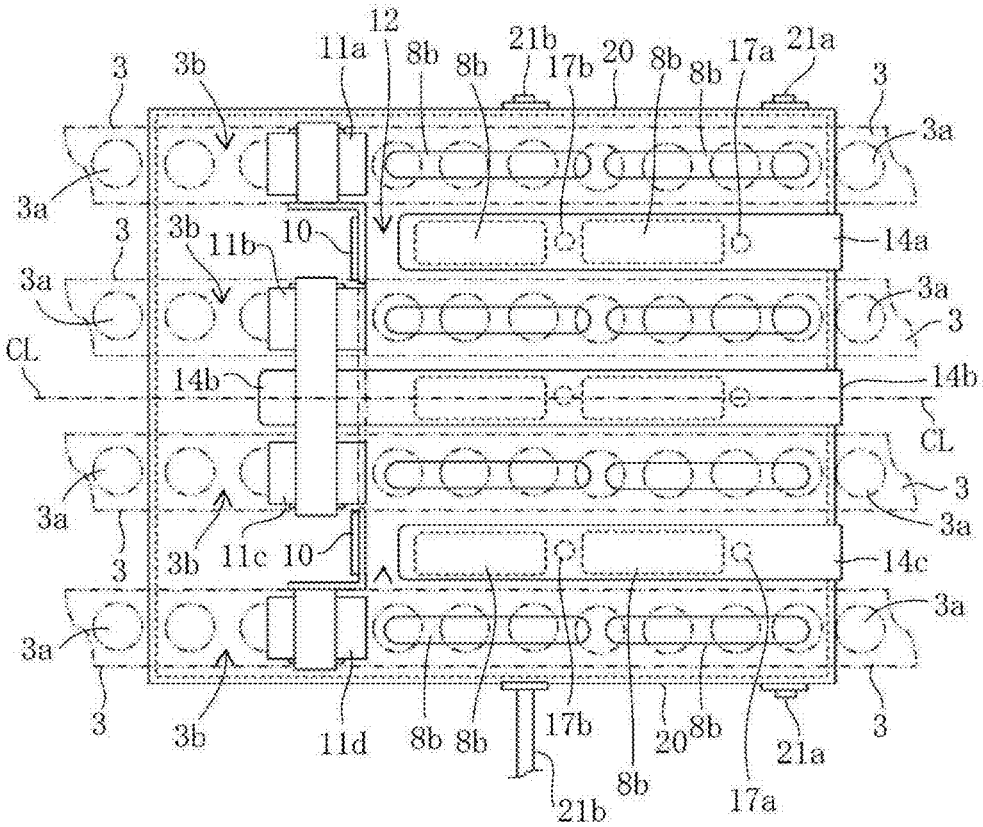
FIG. 4A is a transverse sectional view taken along a line X-X of FIG. 2.
Figure 4B:
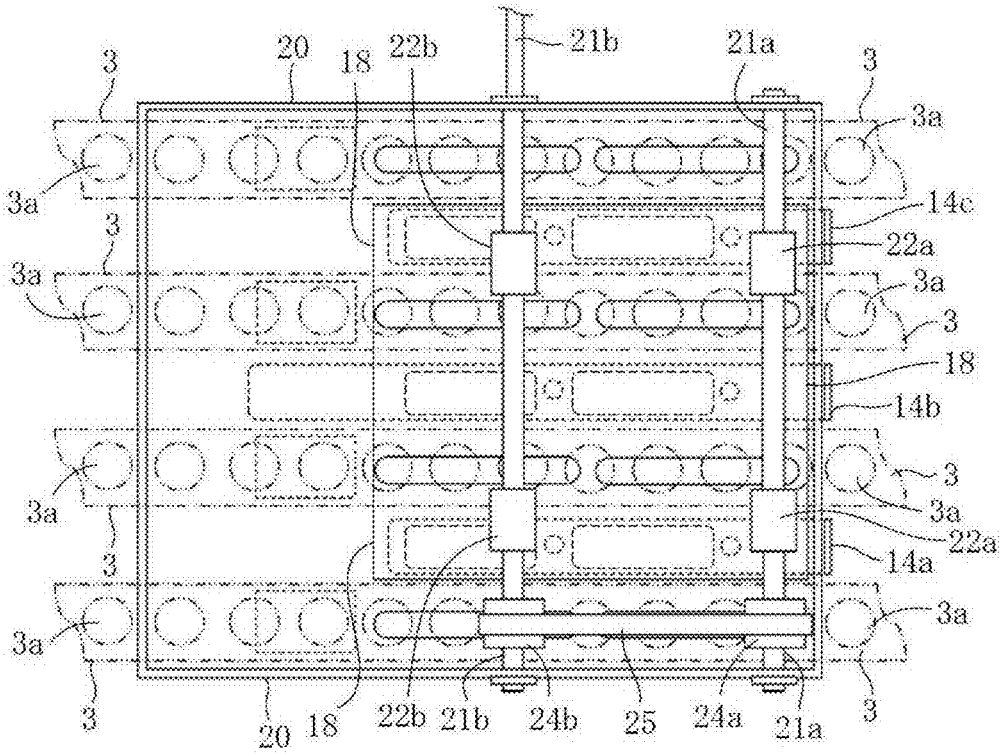
FIG. 4B is a transverse sectional view taken along a line Y-Y of FIG. 2.

FIG. 3A is a vertical sectional view taken along a direction across the feed out direction when viewed from the upstream of the feed out direction of FIG. 2, and FIG. 3B is a side view when viewed from the downstream of the feed out direction of FIG. 2. Further, FIG. 4A is a transverse sectional view taken along a line X-X of FIG. 2, and FIG. 4B is a transverse sectional view taken along a line Y-Y of FIG. 2.

Figure 5A:
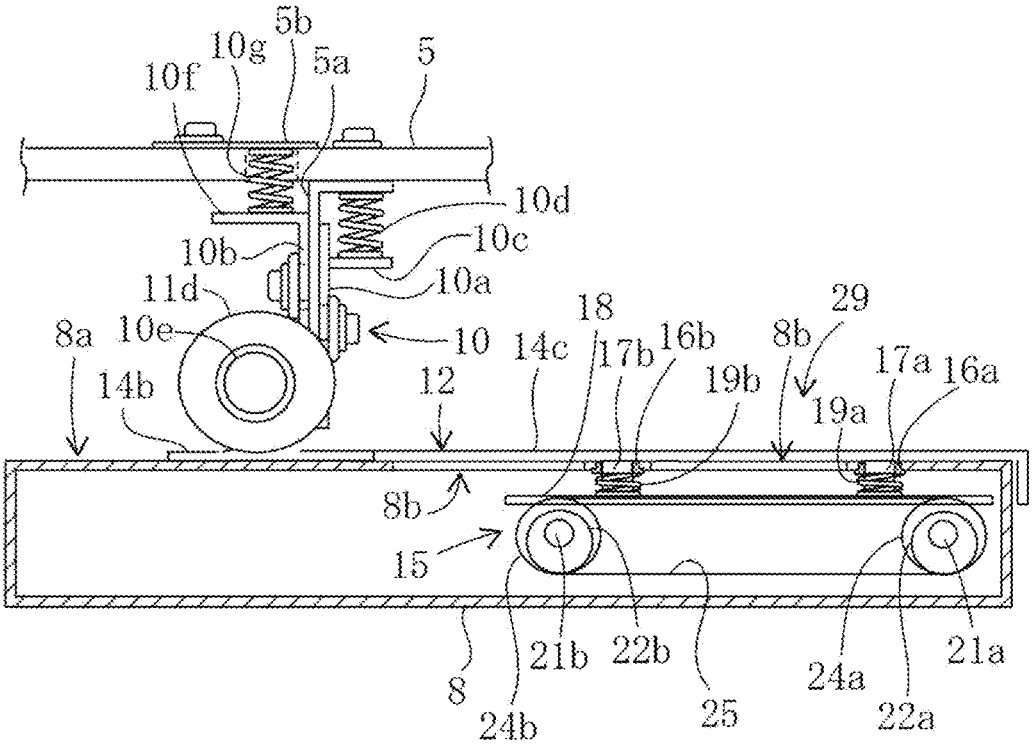
FIG. 5A is an enlarged front view illustrating the suction box and the abutment members of the sheet feeding apparatus of FIG. 1.
Figure 5B:
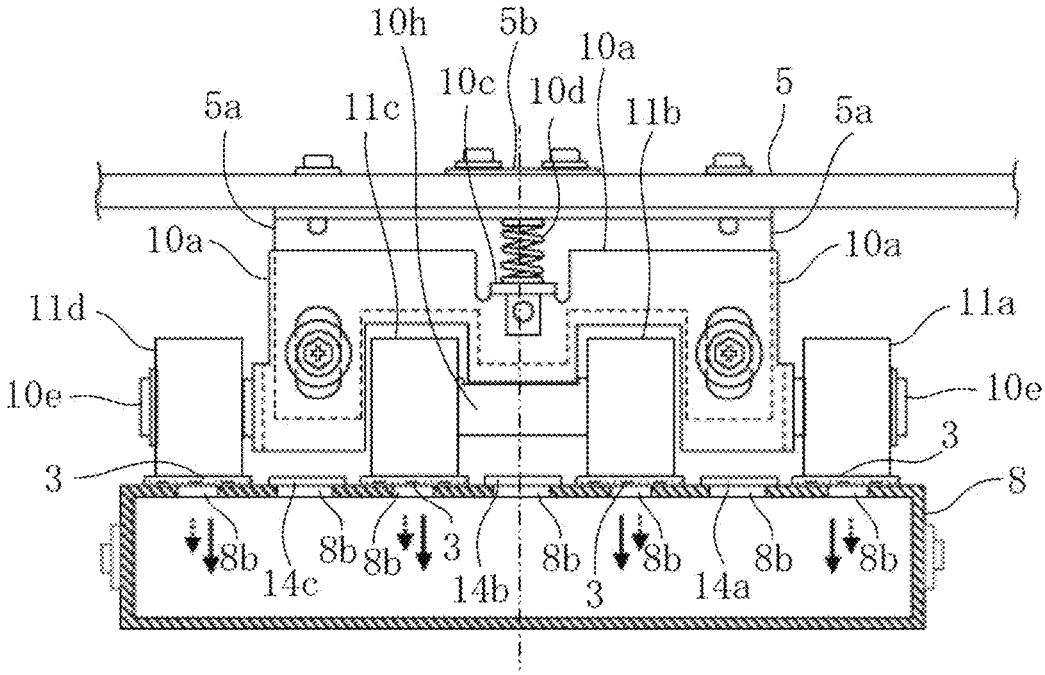
FIG. 5B is a vertical sectional view taken along a direction across the feed out direction when viewed from the upstream of the feed out direction of FIG. 5A.

Further, FIG. 5A is an enlarged front view illustrating the suction box and the abutment members of the sheet feeding apparatus of FIG. 1, and FIG. 5B is a vertical sectional view taken along a direction across the feed out direction when viewed from the upstream of the feed out direction of FIG. 5A.

In this embodiment, the sheet feeding apparatus is arranged between two sheet processing apparatuses and is a sheet feeding apparatus (a sheet feeding apparatus of the bottom feed system) that temporarily accumulates sheets discharged from an upstream sheet processing apparatus and sequentially feeds the lowermost sheet of the accumulated sheets to a downstream sheet processing apparatus.

According to the present embodiment with reference to FIG. 1A to FIG. 5B, provided are a drive roller 1 and an idle roller 2 spaced apart from each other in the feed out direction of sheets and each extending both orthogonally to the feed out direction and horizontally, at least one (in this embodiment, four) perforated endless conveying belt (conveying belt) 3 extended between the drive roller 1 and the idle roller 2, and a roller drive mechanism 4 that rotates the drive roller 1.

The drive roller 1 has a horizontal rotary shaft 1*a* and four first roller elements 1*b* spaced apart from each other in the axial direction and attached to the rotary shaft 1*a* integrally with the rotary shaft 1*a* in a rotatable manner.

As illustrated in FIG. 1A and FIG. 4A, in this embodiment, the four first roller elements 1*b* are arranged symmetrically about a predefined center line CL extending orthogonally to the drive roller 1 and the idle roller 2. The center line CL matches the center in the width direction orthogonal to the feed out direction of a conveyed sheet P1.

The idle roller 2 has four second roller elements 2*b* arranged so as to be rotatable about the shaft 2*a* parallel to the rotary shaft 1*a* of the drive roller 1 and face the four first roller elements 1*b*, respectively.

Further, each perforated endless conveying belt 3 is extended between the paired first roller element 1*b* of the drive roller 1 and second roller element 2*b* of the idle roller 2, and the four perforated endless conveying belts 3 are arranged symmetrically about the center line CL. Each perforated endless conveying belt 3 has a plurality of airflow holes 3*a* evenly over the entire length thereof.

The roller drive mechanism 4 has a pulley 4*a* fixed to one end of the rotary shaft 1*a* of the drive roller 1, a motor 4*b* whose drive shaft extends parallel to the drive roller 1, a pulley 4*c* fixed to the drive shaft of the motor 4*b*, and an endless belt 4*d* extended between the pulley 4*a* and the pulley 4*c*.

In this arrangement, during operation of the sheet feeding apparatus, in response to rotary driving of the drive roller 1 by the motor 4*b*, the four perforated endless conveying belts 3 are simultaneously rotated at a constant speed, and the sheet P1 placed on conveying surfaces 3*b* of the four perforated endless conveying belts 3 is conveyed from the idle roller 2 side to the drive roller 1 side.

Further, provided are a carriage 5 arranged so as to be able to reciprocate in the length direction of the perforated endless conveying belts 3 above the perforated endless conveying belts 3, at least one (in this embodiment, two) slide guide 6 that extends in the length direction of the perforated endless conveying belts 3 and to which the carriage 5 is slidably attached, and a carriage drive mechanism 7 that causes the carriage 5 to slide.

The carriage drive mechanism 7 has a motor 7*a* and a pulley 7*b* arranged spaced apart from each other in the length direction of the slide guide 6. A drive shaft of the motor 7*a* and a rotary shaft of the pulley 7*b* extend parallel to the drive roller 1 and the idle roller 2.

A pulley 7*c* is fixed to the drive shaft of the motor 7*a*, and an endless belt 7*d* is extended between the pulley 7*c* and the pulley 7*b* and extends parallel to the slide guides 6. The carriage 5 is fixed to the endless belt 7*d*.

In this arrangement, in response to the endless belt 7*d* being rotated in forward and reverse directions by the motor 7*a*, the carriage 5 may slide along the slide guides 6 in a reciprocating manner.

Provided are a suction box (suction unit) 8, which is arranged so as to be able to reciprocate in the length direction of the perforated endless conveying belts 3 between the upper belt portions 3*c* and the lower belt portions 3*d* of the four perforated endless conveying belts 3 and attached to the carriage 5, and a suction fan (intake source) 9, which is directly connected to the suction box 8 and generates a negative pressure in the suction box 8.

The upstream in the feed out direction of a surface 8*a* of the suction box 8 facing the upper belt portion 3*c* corresponds to an attracting area 12. A plurality of intake holes (first intake hole) 8*b* are formed in the attracting area 12, and the upper surface of a sheet stack S is arranged so as to face the attracting area 12.

A support 10 is provided downstream of the attracting area 12 in the feed out direction in the suction box 8. The support 10 is arranged above the surface 8*a* and extends across the perforated endless conveying belts 3 in the width direction. Four abutment members 11*a* to 11*d* are supported at positions of the support 10 that correspond to respective perforated endless conveying belts 3. Each of the abutment members 11*a* to 11*d* is pressed against the corresponding perforated endless conveying belt 3.

In this arrangement, the four abutment members 11*a* to 11*d* are arranged symmetrically about the center line CL.

The abutment members 11*a* to 11*d* are formed of retard rollers.

As illustrated in FIGS. 1A-1B, FIG. 2, FIGS. 3A-3B, and FIGS. 5A-5B, a fixed plate 5*a* having an L-shape cross section is attached to the under surface of the carriage 5. The fixed plate 5*a* extends orthogonally to the surface 8*a* of the suction box 8 and in a direction across the perforated endless conveying belts 3 (width direction).

In this arrangement, the support 10 has first and second support plates 10*a* and 10*b* arranged upstream and downstream in the feed out direction interposing the fixed plate 5*a*. The first and second support plates 10*a* and 10*b* extend in a direction across the perforated endless conveying belts 3 and are attached vertically, slidably to the fixed plate 5*a*, respectively.

The first support plate 10*a* has an inverse U-shape, and horizontal support shafts 10*e* extending in the width direction of the perforated endless conveying belts 3 are projected to the outside of respective legs of the first support plate 10*a*. A pair of abutment members 11*a* and 11*d* located at both outsides of the four abutment members 11*a* to 11*d* are attached to these support shafts 10*e*.

A spring bearing 10*c* is provided at the center of the upper end of the first support plate 10*a*, and a compression spring 10*d* that always applies force to the first support plate 10*a* downward against the fixed plate 5*a* (and thus pushes the pair of abutment members 11*a* and 11*d* against the corresponding perforated endless conveying belts 3) is arranged between the spring bearing 10*c* and the fixed plate 5*a*.

The second support plate 10*b* has a T-shape, and horizontal support shafts 10*h* extending in the width direction of the perforated endless conveying belts 3 are provided to the lower end of the second support plate 10*b*. A pair of abutment members 11*b* and 11*c* located at the center of the four abutment members 11*a* to 11*d* are attached to both ends of the support shafts 10*h*.

A spring bearing 10*f* is provided at the center of the upper end of the second support plate 10*b*, and a vertically extending through hole is formed at a position of the carriage 5 corresponding to the spring bearing 10*f*. Further, the compression spring 10*g* is fitted into the through hole with the lower end thereof being pressed against the spring bearing 10*f*, and the upper end opening of the through hole is closed by a press plate 5*b*.

The second support plate 10*b* is always applied with force downward against the fixed plate 5*a* by the compression spring 10*g* (thus, the pair of abutment members 11*b* and 11*c* are pressed against the corresponding perforated endless conveying belts 3).

In such a way, out of the four abutment members 11*a* to 11*d* arranged symmetrically about the center line CL, a pair of abutment members 11*a* and 11*d* and a pair of abutment members 11*b* and 11*c* located at positions symmetrically about the center line CL are separately connected and supported and pressed against the corresponding perforated endless conveying belts 3, this enables even pressing force of the abutment members 11*a* to 11*d* against the perforated endless conveying belts 3 with respect to the center line CL, and this can reliably prevent not only double feeding of the sheet P1 but also the diagonal traveling of the sheet P1.

A pair of discharge rollers 13*a* and 13*b* are attached to the carriage 5. The pair of discharge rollers 13*a* and 13*b* face vertically interposing the conveyance path between the adjacent perforated endless conveying belts 3 downstream of the suction box 8 in the feed out direction and are rotatable about the horizontal shafts orthogonal to the feed out direction, respectively. Three lifting plates 14*a* to 14*c* extending in the length direction of the perforated endless conveying belts 3 are provided between the adjacent perforated endless conveying belts 3 on the surface 8*a* of the suction box 8.

A sheet detection sensor 13*c* is provided downstream of the pair of discharge rollers 13*a* and 13*b* in the feed out direction. The sheet detection sensor 13*c* detects the leading end of the sheet P1 discharged from the discharge rollers 13*a* and 13*b*. The output of the sheet detection sensor 13*c* is transmitted to a control unit (not illustrated).

Three lifting plates 14*a* to 14*c* are arranged symmetrically about the center line CL. Both outside lifting plates 14*a* and 14*c* of the three lifting plates 14*a* to 14*c* extend within a range of the intake holes (second intake hole) 8*b* of the attracting area 12. The center lifting plate 14*b* of the three lifting plates 14*a* to 14*c* extends from the upstream end of the attracting area 12 (the upstream end of the suction box 8) in the feed out direction to a position corresponding to the abutment members 11*a* to 11*d* as illustrated in FIG. 4A, for example (hereafter, the lifting plate 14*b* is referred to as "extended lifting plate 14*b*" in some cases).

The extended lifting plate 14*b* is arranged such that the center in the width direction thereof matches the center line CL (so as to be symmetrical about the center line CL) as illustrated in FIG. 4A.

A lifting plate drive mechanism 15 that moves the lifting plates 14*a* to 14*c* vertically is provided to the carriage 5. The lifting plate drive mechanism 15 is controlled by a control unit (not illustrated). The lifting plate drive mechanism 15 reciprocates the lifting plates 14*a* to 14*c* between a first position at which the lifting plates 14*a* to 14*c* are separated from the surface 8*a* to open the intake holes 8*b* and project out of the conveying surfaces 3*b* of the perforated endless conveying belts 3 (see FIG. 2 and FIGS. 3A-3B) and a second position at which the lifting plates 14*a* to 14*c* are pressed against the surface 8*a* to close the intake holes 8*b* and are at the same level as the conveying surfaces 3*b* of the perforated endless conveying belts 3 or retract below the conveying surfaces 3*b* (see FIGS. 5A-5B).

As illustrated in FIG. 2, for example, the lifting plate drive mechanism 15 has two bushes 16*a* and 16*b*, which are arranged spaced apart from each other in the length direction of the lifting plates 14*a* to 14*c* at positions facing respective lifting plates 14*a* to 14*c* of a wall of the suction box 8 and respectively penetrate and extend through the wall, and guide rods 17*a* and 17*b*, which penetrate respective bushes 16*a* and 16*b*, whose upper ends connect to the back surfaces of the corresponding lifting plates 14*a* and 14*c*, and whose lower ends extend in the suction box 8.

The lower ends of respective guide rods 17*a* and 17*b* are coupled by a single horizontal connecting plate 18, and compression springs 19*a* and 19*b* each wind around the outside of a portion of each of the guide rods 17*a* and 17*b* projecting inside the suction box 8, extend between the connecting plate 18 and the suction box 8, and always apply force to the lifting plates 14*a* to 14*c* toward the second position.

The lifting plate drive mechanism 15 further has two rotary shafts 21*a* and 21*b* spaced apart from each other in the length direction of the lifting plates 14*a* to 14*c* under the connecting plate 18 inside the suction box 8 and extending horizontally in the width direction of the lifting plates 14*a* to 14*c*, respectively.

Each of the two rotary shafts 21*a* and 21*b* is supported rotatably about the shaft by a pair of frame parts 20 extending in the length direction of the lifting plates 14*a* to 14*c* in a rectangular support frame attached to the bottom inside the suction box 8 (for example, see FIG. 4A and FIG. 4B).

As illustrated in FIG. 4A and FIG. 4B, one end of the rotary shaft 21*b*, which is one of the two rotary shafts 21*a* and 21*b*, penetrates through the frame part 20 and projects outside the suction box 8.

The lifting plate drive mechanism 15 further has a pair of plate cams 22*a* and 22*a* and a pair of plate cams 22*b* and 22*b*, which are attached to positions corresponding to both sides of the connecting plate 18 on respective rotary shafts 21*a* and 21*b* integrally with the rotary shafts 21*a* and 21*b* in a rotatable manner, and a cam drive mechanism 23, which rotates the two rotary shafts 21*a* and 21*b* synchronously.

In such a case, the plate cams 22*a* and 22*b* and the connecting plate 18 are arranged such that, when the plate cams 22*a* and 22*b* take the bottom dead center, the plate cams 22*a* and 22*b* are separated from the connecting plate 18 and the lifting plates 14*a* to 14*c* take the second position as illustrated in FIG. 5A and, on the other hand, when the plate cams 22*a* and 22*b* take the top dead center, the connecting plate 18 is pushed up by the plate cams 22*a* and 22*b* and the lifting plates 14*a* to 14*c* take the first position as illustrated in FIG. 2.

The cam drive mechanism 23 has a pulley 24*a* fixed to one end side of the rotary shaft 21*a*, a pulley 24*b* fixed to a position located on the rotary shaft 21*b* and corresponding to the pulley 24*a*, and an endless belt 25 extended between the pulley 24*a* and the pulley 24*b*. Furthermore, as illustrated in FIG. 1A, the cam drive mechanism 23 has a motor 26 fixed to the carriage 5 outside the suction box 8 and having the drive shaft extending parallel to the rotary shaft 21*b*, a pulley 27*a* fixed to the drive shaft of the motor 26, a pulley 27*b* fixed to a position located on the rotary shaft 21*b* and corresponding to the pulley 27*a*, and an endless belt 28 extended between the pulley 27*a* and the pulley 27*b*.

In such a way, the two rotary shafts 21*a* and 21*b* are synchronously rotated by the motor, and in response, the plate cams 22*a* and 22*b* are rotated.

Then, the lifting plates 14*a* to 14*c* take the second position when the plate cams 22*a* and 22*b* take the bottom dead center, and the lifting plates 14*a* to 14*c* take the first position when the plate cams 22*a* and 22*b* take the top dead center.

As illustrated in FIG. 1B, a region on the conveying surfaces 3*b* of the perforated endless conveying belts 3 from the abutment members 11*a* to 11*d* to the upstream end u of the conveying surfaces 3*b* forms a sheet accumulation area 29.

As illustrated in FIG. 1A and FIG. 1B, an air blow-off unit 30 attached to the carriage 5 is provided. The air blow-off unit 30 is arranged downstream of the abutment members 11*a* to 11*d* in the feed out direction and above the conveying surfaces 3*b* of the perforated endless conveying belts 3 and blows separating air to the upstream along the conveying surface 3*b* in the conveyance direction.

Note that the air blow-off unit 30 is provided if necessary and may be omitted.

The control unit is a computer system (calculator system) and includes a CPU, a read only memory (ROM) for storing a program or the like executed by the CPU, a random access memory (RAM) functioning as a work area during execution of each program, a hard disk drive (HDD) as a mass storage device, and a communication unit for a connection to a network or the like, for example. These components are connected via a bus.

A process of a series of operations for implementing respective functions described later is stored in a hard disk drive or the like in a form of a program, and the CPU loads such a program into the RAM or the like and performs information processing and computing process, and thereby various functions described later are implemented. Note that a form in which a program is installed in advance in a ROM or other storage mediums, a form in which a program is provided in a state of being stored in a computer readable storage medium, a form in which a program is delivered via a wired or wireless communication unit, or the like may be applied. The computer readable storage medium is a magnetic disk, a magneto-optical disk, a CD-ROM, a DVD-ROM, a semiconductor memory, or the like.

Figure 8A:
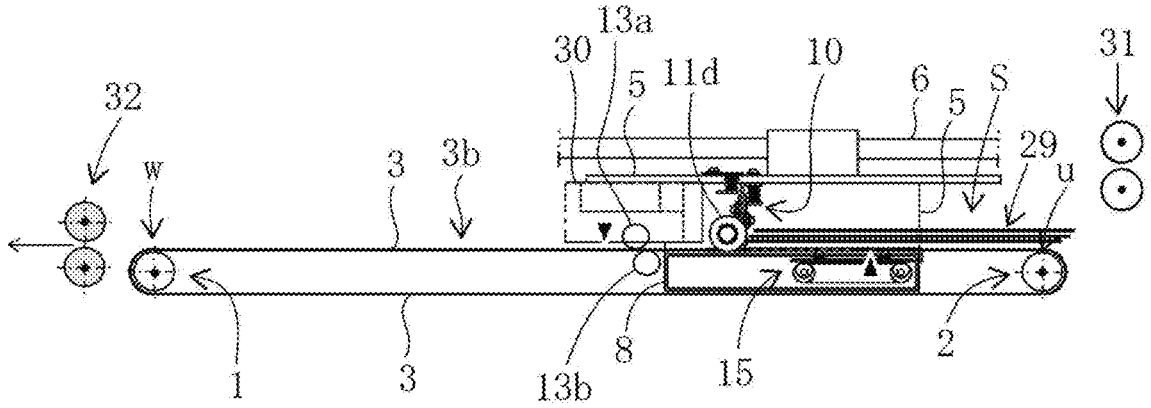
FIG. 8A is a front view illustrating movement of a carriage of a sheet feeding apparatus of FIG. 1 in which the carriage is located in a position where the length of the sheet accumulation area become minimum.
Figure 8B:
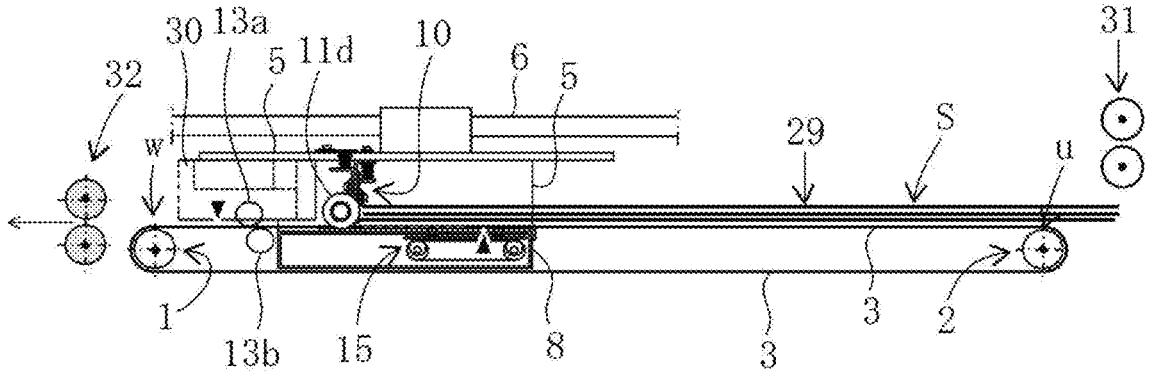
FIG. 8B is a front view illustrating movement of a carriage of a sheet feeding apparatus of FIG. 1 in which the carriage is located in a position where the length of the sheet accumulation area become maximum.

The length of the sheet accumulation area 29 can be changed within a range between the minimum length (see FIG. 8A) and the maximum length (see FIG. 8B) by changing the position of the carriage 5, that is, the positions of the suction box 8, the abutment members 11*a* to 11*d*, the pair of discharge rollers 13*a* and 13*b*, and the air blow-off unit 30.

Accordingly, even when the length of sheets to be fed is changed, such a change in the sheet size can be easily and quickly coped with by adjustment of the length of the sheet accumulation area 29.

Next, the operation of the sheet feeding apparatus of the present embodiment will be described.

Figure 6A:
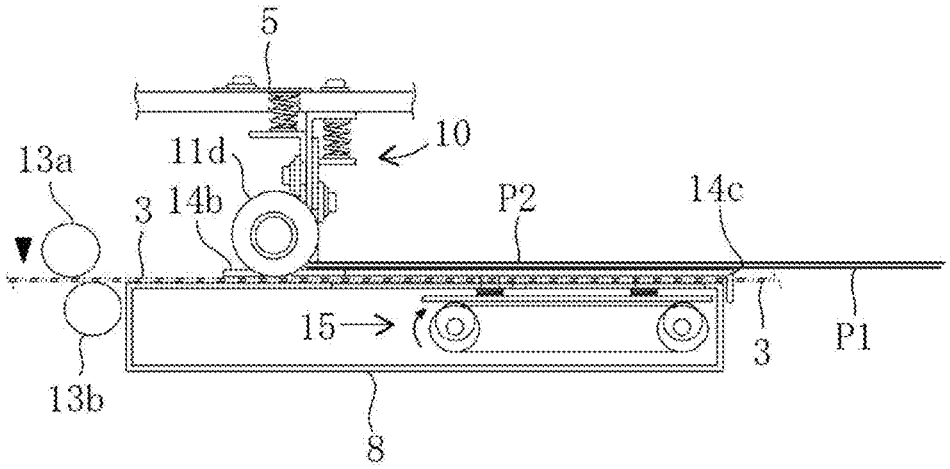
FIG. 6A is a diagram similar to FIG. 2 and illustrating a sheet feeding operation of the sheet feeding apparatus of FIG. 1.
Figure 6B:
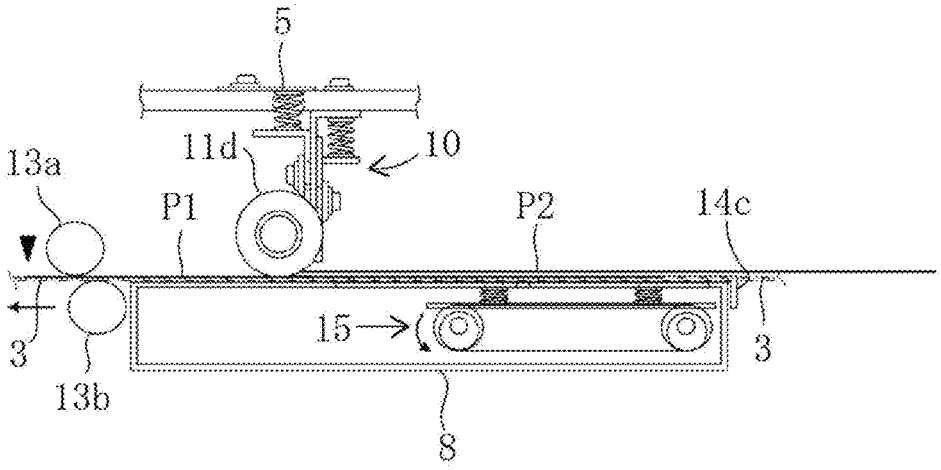
FIG. 6B is a diagram similar to FIG. 2 and illustrating a sheet feeding operation of the sheet feeding apparatus of FIG. 1.
Figure 6C:
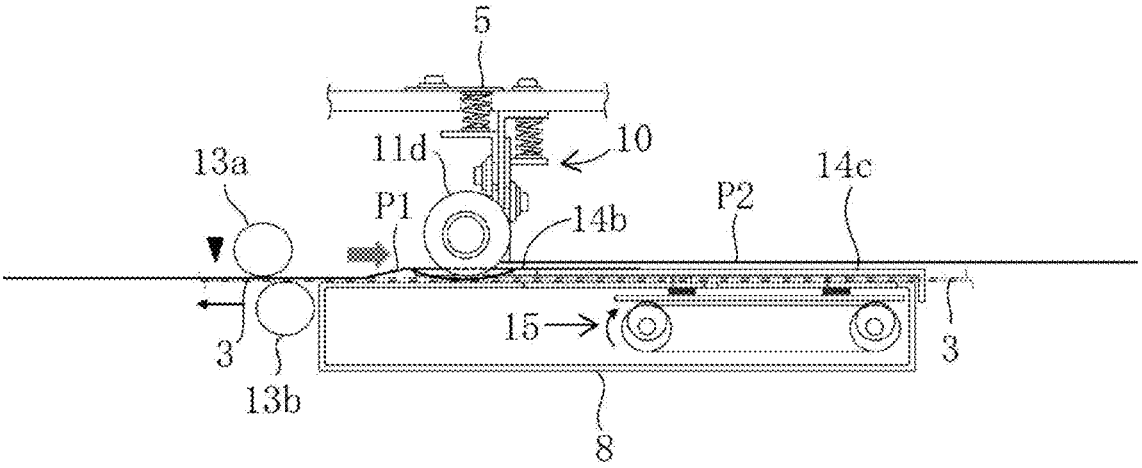
FIG. 6C is a diagram similar to FIG. 2 and illustrating a sheet feeding operation of the sheet feeding apparatus of FIG. 1.

FIG. 6A, FIG. 6B, and FIG. 6C are diagrams similar to FIG. 2 and illustrating a sheet feeding operation of the sheet feeding apparatus of FIGS. 1A-1B, and FIG. 7A, FIG. 7B, and FIG. 7C are diagrams similar to FIG. 3A and illustrating a sheet feeding operation of the sheet feeding apparatus of FIGS. 1A-1B.

First, reference is made to FIGS. 1A-1B, and prior to operation of the sheet feeding apparatus, the upstream sheet processing apparatus is connected to the upstream end u (see FIG. 1B) of the conveyance path of the perforated endless conveying belts 3, and on the other hand, the downstream sheet processing apparatus is connected to the downstream end w (see FIG. 1B) of the conveying surfaces 3*b* of the perforated endless conveying belts 3.

Note that, in FIG. 1B, a pair of conveying rollers 31 provided to a sheet exit of the upstream sheet processing apparatus and extending in a direction across the sheet accumulation area 29 of the sheet feeding apparatus are depicted as a representative of the upstream sheet processing apparatus. Further, a pair of conveying rollers 32 provided to a sheet entrance of the downstream sheet processing apparatus and extending in a direction across the conveying surfaces 3*b* of the perforated endless conveying belts 3 of the sheet feeding apparatus are depicted as a representative of the downstream sheet processing apparatus.

Next, the position of the carriage 5, that is, the positions of the suction box 8, the abutment members 11*a* to 11*d*, the lifting plate drive mechanism 15, the pair of discharge rollers 13*a* and 13*b*, and the air blow-off unit 30 are adjusted in accordance with the length of a sheet to be processed (feed out direction length), and the length of the sheet accumulation area 29 is set.

Figure 7A:
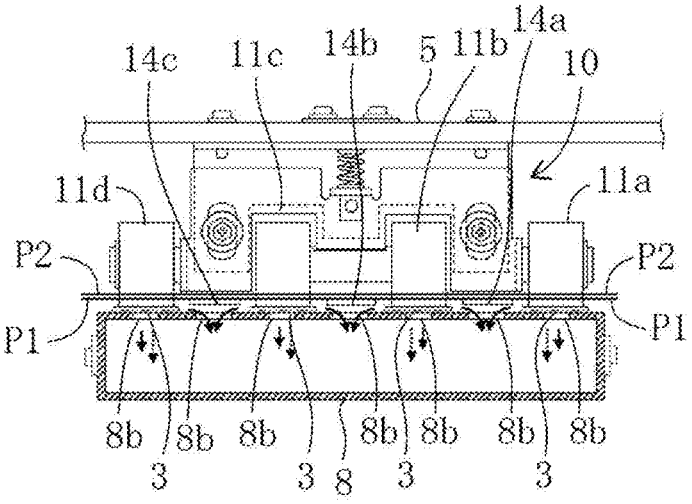
FIG. 7A is a diagram similar to FIG. 3A and illustrating a sheet feeding operation of the sheet feeding apparatus of FIG. 1.

Once the operation of the sheet feeding apparatus and respective sheet processing apparatuses is started, the first (the lowermost) sheet P1 is conveyed by the pair of conveying rollers 31 of the upstream sheet processing apparatus and enters the sheet accumulation area 29 of the sheet feeding apparatus. Then, before the leading end of the first (the lowermost) sheet P1 reaches an abutment part between the abutment members 11*a* to 11*d* and the perforated endless conveying belts 3, the lifting plates 14*a* to 14*c* rise from the second position to the first position as illustrated in FIG. 6A and FIG. 7A.

When the lifting plates 14*a* to 14*c* take the first position, the intake holes (second intake hole) 8*b* facing the lifting plates 14*a* to 14*c* in the attracting area 12 are opened, outer air flows into the suction box 8 from these opened intake holes 8*b*, and thereby, the attracting force by the perforated endless conveying belts 3 is reduced. At the same time, the first (the lowermost) sheet P1 on the attracting area 12 is separated from the perforated endless conveying belt 3.

This reduces the conveying power of the perforated endless conveying belts 3 in the attracting area 12.

In such a way, the first (the lowermost) sheet P1 is blocked by the abutment members 11*a* to 11*d* and, in this state, retained in the sheet accumulation area 29.

The next sheet P2 is then conveyed by the pair of conveying rollers 31, a sheet feeding signal is transmitted from the downstream sheet processing apparatus to the sheet feeding apparatus at a timing that the sheet P2 is stacked on the first (the lowermost) sheet P1, and a sheet feeding operation of the sheet feeding apparatus is started.

Figure 7B:
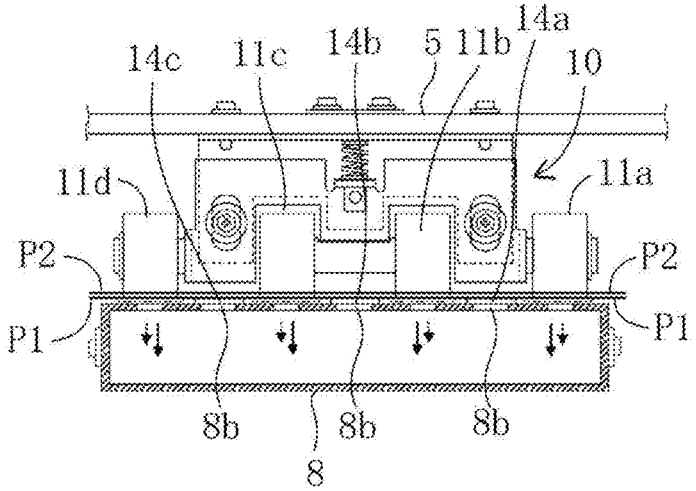
FIG. 7B is a diagram similar to FIG. 3A and illustrating a sheet feeding operation of the sheet feeding apparatus of FIG. 1.

At this timing of the start of a sheet feeding operation of the first (the lowermost) sheet P1, the perforated endless conveying belts 3, the suction fan 9, the air blow-off unit 30, and the pair of discharge rollers 13*a* and 13*b* start continuous operation, and the lifting plates 14*a* to 14*c* are moved down from the first position to the second position as illustrated in FIG. 6B and FIG. 7B.

When the lifting plates 14*a* to 14*c* take the second position, the intake holes 8*b* facing the lifting plates 14*a* to 14*c* in the attracting area 12 are closed, the outside air flows into the suction box 8 via only the airflow holes 3*a* of the perforated endless conveying belts 3, and therefore, the attracting force of the perforated endless conveying belts 3 is increased. At the same time, the lowermost sheet P1 and the perforated endless conveying belts 3 come into contact with each other.

This increases the conveying power of the perforated endless conveying belts 3 in the attracting area 12.

In such a way, the lowermost sheet P1 is conveyed while being attracted by the perforated endless conveying belts 3 and is fed out after passing between the abutment members 11*a* to 11*d* and the perforated endless conveying belts 3.

Figure 7C:
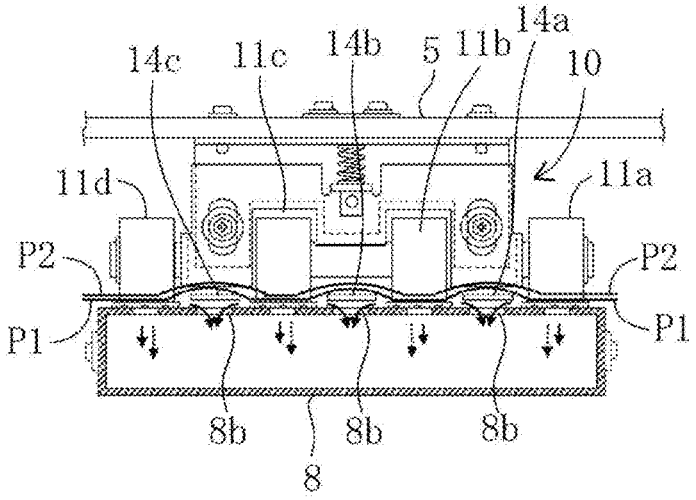
FIG. 7C is a diagram similar to FIG. 3A and illustrating a sheet feeding operation of the sheet feeding apparatus of FIG. 1

Then, when the leading end of the lowermost sheet P1 has passed through the pair of discharge rollers 13*a* and 13*b*, the sheet detection sensor 13*c* detects the leading end of the sheet P1, and the lifting plates 14*a* to 14*c* rise from the second position to the first position as illustrated in FIG. 6C and FIG. 7C in accordance with an instruction of the control unit.

When the lifting plates 14*a* to 14*c* take the first position, the intake holes 8*b* facing the lifting plates 14*a* to 14*c* in the attracting area 12 are opened, outside air flows from the opened intake holes 8*b* into the suction box 8, and therefore, the attracting force by the perforated endless conveying belts 3 is reduced. At the same time, the lowermost sheet P1 on the attracting area 12 is separated from the perforated endless conveying belts 3.

This reduces the conveying power of the perforated endless conveying belts 3 in the attracting area 12.

Further, when the lifting plates 14*a* to 14*c* take the first position, the lowermost sheet P1 and the next sheet P2 are corrugated in an orientation across the feed out direction.

Furthermore, with respect to the extended lifting plate 14*b*, when the extended lifting plate 14*b* takes the first position, the effects and advantages described above are obtained, and in addition, the lowermost sheet P1 is lifted both directly under and in the downstream of the abutment members 11*a* to 11*d* by the extended lifting plate 14*b*, pressed against the abutment members 11*a* to 11*d* and corrugated in the orientation across the feed out direction.

Accordingly, a gap occurs between the lowermost sheet P1 and the next sheet P2, this facilitates inflow of separating air between the sheet P1 and the sheet P2, and a blocking force of the sheet P2 by the abutment members 11*a* to 11*d* further increases.

In such a way, while the lowermost sheet P1 continues to be fed out, the next sheet P2 is reliably blocked by the abutment members 11*a* to 11*d*.

Then, a sheet feeding signal is transmitted from the downstream sheet processing apparatus to the sheet feeding apparatus at a timing of completion of feed out of the lowermost sheet P1, the lifting plates 14*a* to 14*c* are moved down from the first position to the second position in response to the sheet feeding signal, and a sheet feeding operation of the next sheet P2 is started.

On the other hand, the lowermost sheet P1 that has passed between the pair of discharge rollers 13*a* and 13*b* is conveyed to the part between the pair of conveying rollers 32 of the downstream sheet processing apparatus by the perforated endless conveying belts 3 and then taken in the downstream sheet processing apparatus by the pair of conveying rollers 32.

In such a way, according to the present embodiment, the lifting plates 14*a* to 14*c* are arranged at least in the attracting area 12 of the suction box 8, and the lifting plates 14*a* to 14*c* are moved up and down at predetermined timings. Thereby, switching between increase and decrease of the sheet attracting force caused by the perforated endless conveying belts 3 and switching between contact and separation between the lowermost sheet P1 of the sheet stack S and the perforated endless conveying belts 3 are simultaneously performed, and the sheet P1 and the next sheet P2 are corrugated in the orientation across the feed out direction when the lowermost sheet P1 is fed out. Therefore, a sheet can be reliably separated and supplied one by one from a sheet stack even with a wide range of differences in size, thickness, weight, and the like of sheets.

That is, the lowermost sheet P1 of a sheet stack is sucked and attracted on the conveying surfaces 3*b* of the perforated endless conveying belts 3 from the first intake holes 8*b* of the suction box 8 via the airflow holes 3*a*. The sheet P1 is attracted on the conveying surfaces 3*b* in such a way and conveyed in this state. Then, once the leading end of the sheet P1 is gripped between the discharge rollers 13*a* and 13*b*, the lifting plates 14*a* to 14*c* are moved from the second position to the first position. Accordingly, the sheet P1 is separated from the conveying surfaces 3*b* of the perforated endless conveying belts 3 by the lifting plates 14*a* to 14*c*, and the second intake holes 8*b* that have been closed by the lifting plates 14*a* to 14*c* are opened. Separation of the sheet P1 from the conveying surfaces 3*b* of the perforated endless conveying belts 3 causes a change in the height position to occur between the lifting plates 14*a* to 14*c* and the conveying surfaces 3*b* and deforms the sheet P1, and this facilitates separation of the sheet P1 being conveyed from the next sheet P2 overlapped on the sheet P1. Further, opening of the second intake holes 8*b* that have been closed by the lifting plates 14*a* to 14*c* reduces the suction force from the first intake holes 8*b*, and reduces the attracting force for the sheet P1 in the conveying surfaces 3*b*, which can reduce the conveying force for the next sheet P2 subsequent to the sheet P1 being conveyed.

Since the lifting plate 14*b* is provided extending to the position corresponding to the abutment members 11*b* and 11*c* or the downstream from the abutment members 11*b* and 11*c* in the feed out direction, the sheet P1 interposed between the abutment members 11*b* and 11*c* and the perforated endless conveying belts 3 can be significantly deformed by the lifting plate 14*b* when the lifting plate 14*b* is at the first position. Accordingly, the sheet P1 being conveyed and the next sheet P2 subsequent thereto have different shapes, and thereby, the next sheet P2 is less likely to enter the abutment members 11*b* and 11*c*.

Although the preferred embodiment of the present disclosure has been described above, the configuration of the present disclosure is not limited to the embodiment described above, and needless to say, those skilled in the art may contrive various modifications within a scope of the features recited in the claims of the present application.

For example, although the pair of discharge rollers 13*a* and 13*b* are arranged downstream of the suction box 8 in the feed out direction and the lifting plates 14*a* to 14*c* are moved up from the second position to the first position at a timing that the leading end of the lowermost sheet P1 of the sheet stack S passes between the pair of discharge rollers 13*a* and 13*b* in the embodiment described above, the pair of discharge rollers 13*a* and 13*b* are not the essential requirement of the present disclosure and are provided if necessary.

Note that, if the pair of discharge rollers 13*a* and 13*b* are not provided, the lifting plates 14*a* to 14*c* can be moved up from the second position to the first position when the lowermost sheet P1 has been fed out by a predetermined length from the abutment members 11*a* to 11*d* after the sheet feeding operation was started.

Further, although the abutment members 11*a* to 11*d* are formed of retard rollers in the embodiment described above, plate-like or block-like elastic members may be used, for example, instead of the retard rollers as the abutment members 11*a* to 11*d*.

Further, although the sheet feeding apparatus is arranged between two sheet processing apparatuses and is a sheet feeding apparatus that temporarily accumulates sheets discharged from the upstream sheet processing apparatus and sequentially feeds the lowermost sheet of the accumulated sheets to the downstream sheet processing apparatus and the length of the sheet accumulation area 29 can be changed in order to cope with various sheet sizes in the embodiment described above, the sheet feeding apparatus can be configured as a typical sheet feeding apparatus.

When the sheet feeding apparatus of the present disclosure is a typical sheet feeding apparatus, the sheet accumulation area 29 is configured as a sheet loading area having a fixed length. Thus, in such a case, the carriage 5, the slide guide 6, and the carriage drive mechanism 7 are omitted, and the suction box 8, the abutment members 11*a* to 11*d*, the lifting plate drive mechanism 15, the pair of discharge rollers 13*a* and 13*b*, and the air blow-off unit 30 are fixed to or supported by the frame of the sheet feeding apparatus.

Figure 9:
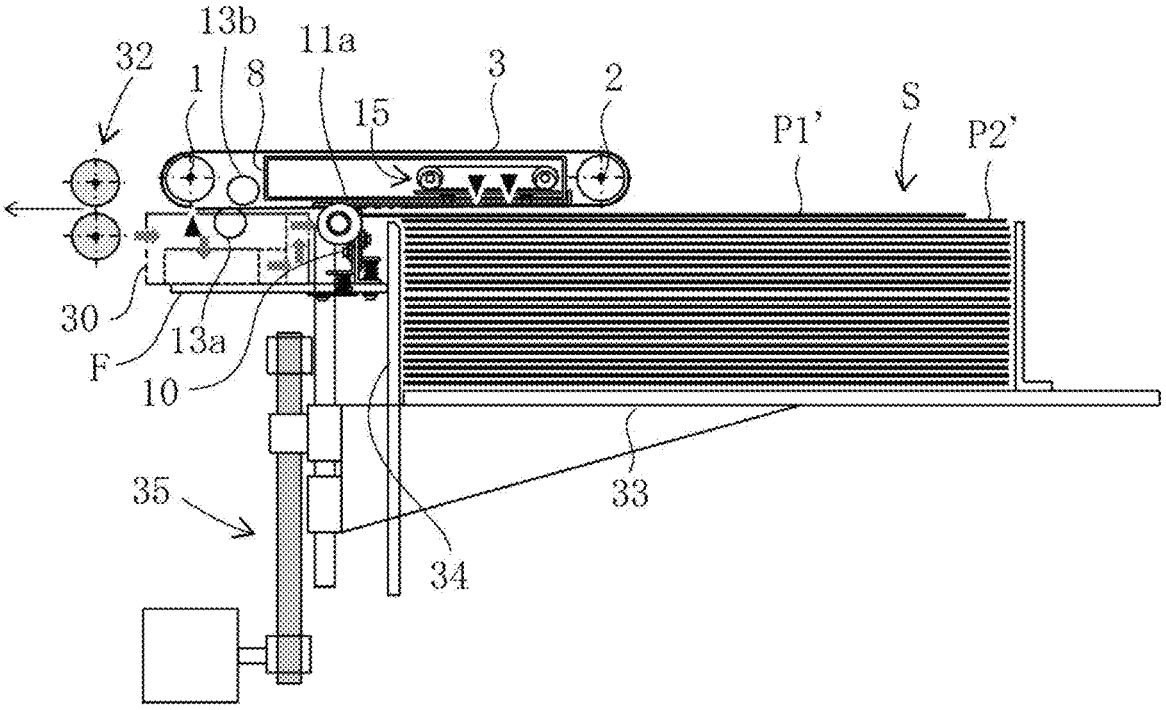
FIG. 9 is a plan view illustrating a schematic diagram of a sheet feeding apparatus according to another embodiment of the present disclosure.

Further, although the sheet feeding apparatus is a sheet feeding apparatus of the bottom feed system in the embodiment described above, the sheet feeding apparatus can be a sheet feeding apparatus of the top feed system if the sheet feeding apparatus of the embodiment described above is arranged upside down and configured such that the top face of the sheet stack S is arranged so as to face the attracting area of the suction box 8, as illustrated in FIG. 9.

Note that, in FIG. 9, the reference numeral 33 represents a sheet placement stage which is provided to the frame F of the sheet feeding apparatus so as to be vertically movable and on which the sheet stack S is placed, the reference numeral 34 represents a perpendicular alignment plate arranged neighboring the front of the sheet placement stage 33 and facing the front end face of the sheet stack S on the sheet placement stage, and the reference numeral 35 represents a lifting mechanism that moves up and down the sheet placement stage 33.

In such a way, once a sheet feeding operation of the sheet feeding apparatus is started, the uppermost sheet P1' of the sheet stack S is conveyed beyond the alignment plate 34 while being attracted by the perforated endless conveying belts 3 and is fed out after passing between the abutment members 11*a* to 11*d* and the perforated endless conveying belts.

In feeding out of the uppermost sheet P1', if the next sheet P2' follows this feeding out operation and is conveyed beyond the alignment plate 34, the next sheet P2' is reliably blocked by the abutment members 11*a* to 11*d*.

Also in the modified example of FIG. 9, the same advantageous effects as those in the embodiment of FIG. 1A to FIG. 8B are obtained.

Second Embodiment

Next, the second embodiment of the present disclosure will be described. The present embodiment differs from the first embodiment described above in that an abutment plate that is a plate-like member is used instead of the retard rollers as the abutment members 11*a* to 11*d*. Since other features are basically the same, different features from those of the first embodiment will be described, common features are labeled with the same reference numerals, and the description thereof will be omitted in the following description.

Figure 10:
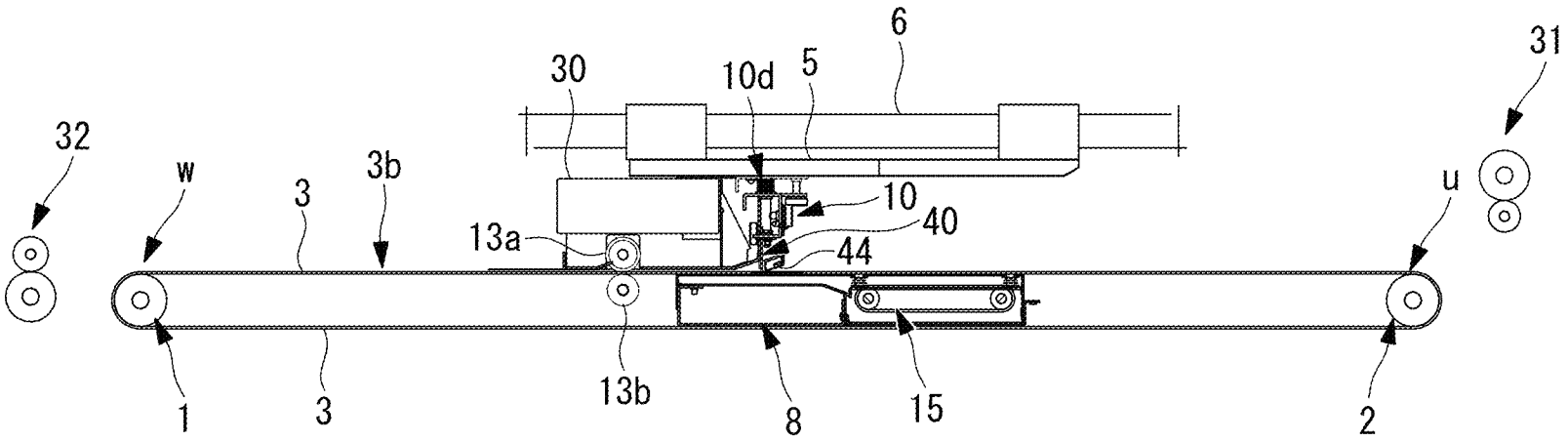
FIG. 10 is a side view illustrating a sheet feeding apparatus of a second embodiment of the present disclosure.
Figure 11:
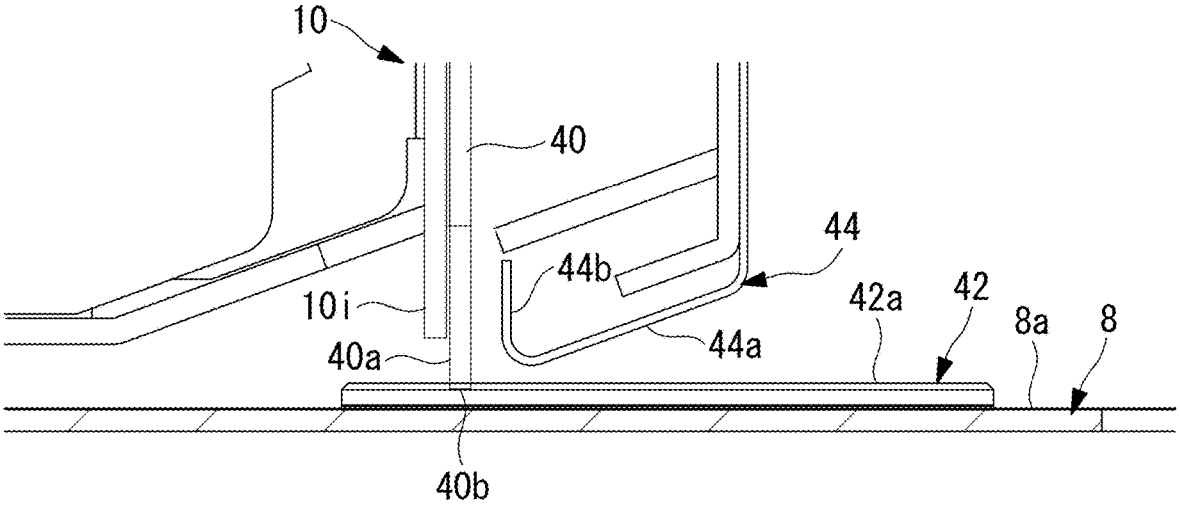
FIG. 11 shows an enlarged view illustrating an abutment plate of FIG. 10.

As illustrated in FIG. 10, an abutment plate (abutment member) 40 is attached to the support 10 provided under the carriage 5. The abutment plate 40 is an elastic member such as a rubber and has a plate shape. As illustrated in FIG. 10, the abutment plate 40 is perpendicularly erected and provided in a state where the wider surface faces the conveyance direction. As illustrated in FIG. 11, the abutment plate 40 is arranged such that the backside (downstream in the conveyance direction: the left side in FIG. 11) is supported by a back plate 10*i* of the support 10. A tip 40*a* of the abutment plate 40 projects downward from the back plate 10*i*. The tip 40*a* side of the abutment plate 40 is elastically deformed within a range of this projection region. The abutment plate 40 is detachable from the support 10. This enables easy replacement when the abutment plate 40 is worn or the like.

The shape of the lower end of the abutment plate 40 is, for example, a rectangle or a trapezoidal shape tapered downward when viewed from the conveyance direction. A lower edge 40*b* of the tip 40*a* of the abutment plate 40 is provided so as to contact with a top surface (contact surface) 42*a* of a bearing plate 42 facing the lower edge 40*b*.

The bearing plate 42 has a planar shape and is fixed to the surface 8*a* on the suction box 8. The height of the upper surface 42*a* of the bearing plate 42 is the same height of the conveying surfaces 3*b* of the endless conveying belts 3. Therefore, a sheet conveyed on the conveying surfaces 3*b* of the endless conveying belts 3 slides and passes on the upper surface 42*a* of the bearing plate 42.

The contact state between the lower edge 40*b* of the abutment plate 40 and the upper surface 42*a* of the bearing plate 42 is set to the extend that one sheet can pass therethrough. Such a setting of the contact state is performed by using a height adjustment component provided to the support 10 and a compression spring 10*d* (see FIG. 10) that applies downward force to the abutment plate 40.

A guide plate 44 is provided upstream of the abutment plate 40 in the conveyance direction (the right side in FIG. 11). The guide plate 44 is fixed to the support 10 side. The guide plate 44 has a slope part 44*a* provided such that the distance to the bearing plate 42 gradually decreases in the conveyance direction. It is preferable to provide the slope part 44*a* such that the extension line of the slope part 44*a* substantially matches the lower edge 40*b* of the abutment plate 40.

A stopper 44*b* bent in an R-shape and erected upward is connected to the slope part 44*a* on the abutment plate 40 side. The stopper 44*b* is provided such that a predetermined gap is present between the abutment plate 40 and the stopper 44*b*. When the tip 40*a* of the abutment plate 40 is elastically deformed to the guide plate 44 side, deformation of the abutment plate 40 is restricted by the stopper 44*b*.

Figure 12:
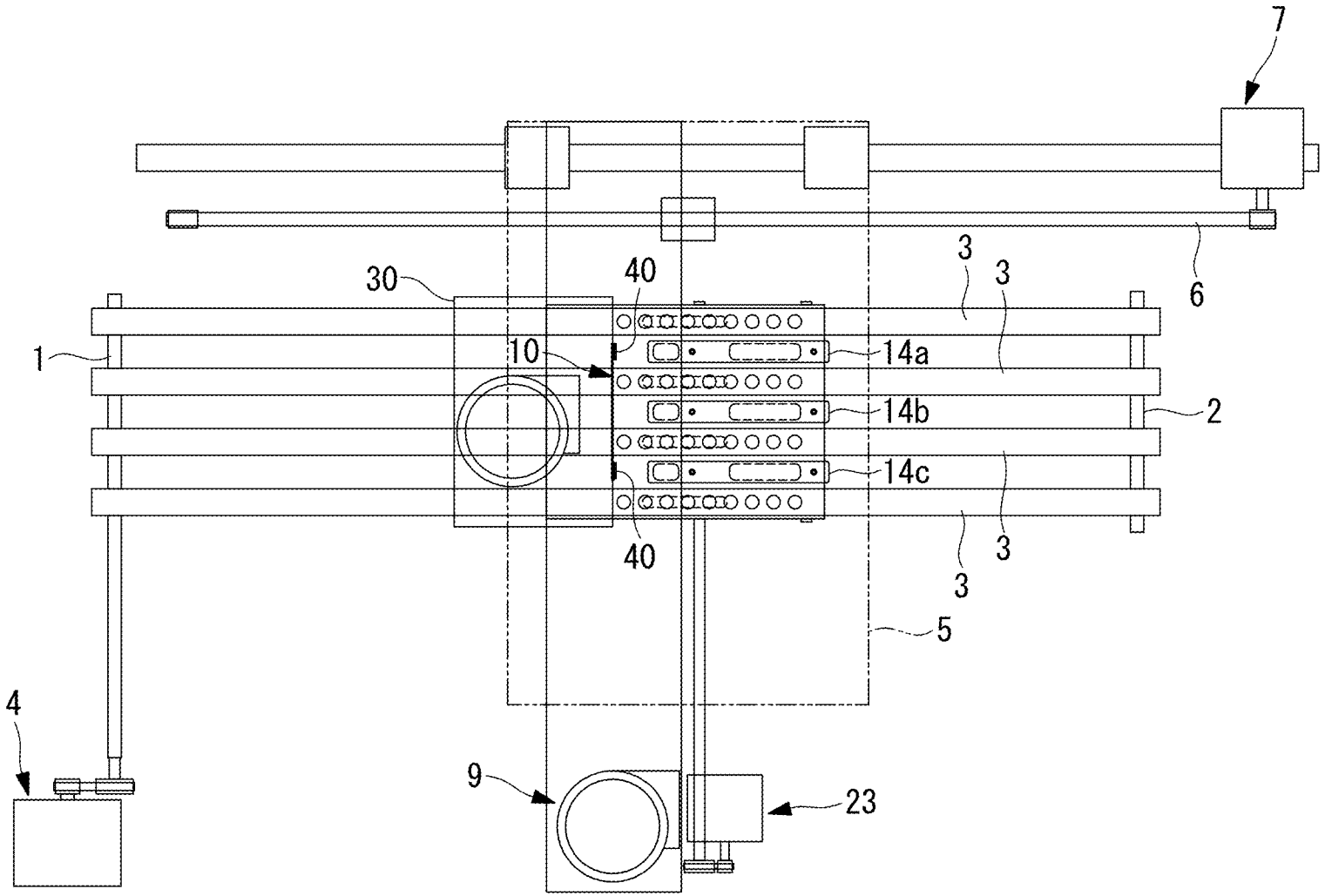
FIG. 12 is a plan view illustrating a sheet feeding apparatus of a second embodiment of the present disclosure.

As illustrated in FIG. 12, two abutment plates 40 are provided laterally when viewed in plan view. Specifically, one of the abutment plates 40 is provided between two endless conveying belts 3 from one end of the four endless conveying belts 3, and the other is provided between two endless conveying belts 3 from the other end. Note that the abutment plate 40 may be provided to another position, that is, may be provided between the center two of the four endless conveying belts 3 or may be provided outside of the four endless conveying belts 3. The abutment plate 40 is not provided above the endless conveying belts 3 unlike the retard rollers described in the first embodiment. That is, as also illustrated in FIG. 11, the abutment plate 40 is provided on the stationary bearing plate 42.

In the present embodiment, the three lifting plates 14*a*, 14*b*, and 14*c* have the same size in the longitudinal direction. Therefore, ends on the abutment plate 40 side of the three lifting plates 14*a*, 14*b*, and 14*c* are located upstream from the abutment plate 40 in the conveyance direction (the right side in FIG. 12).

Figure 13A:
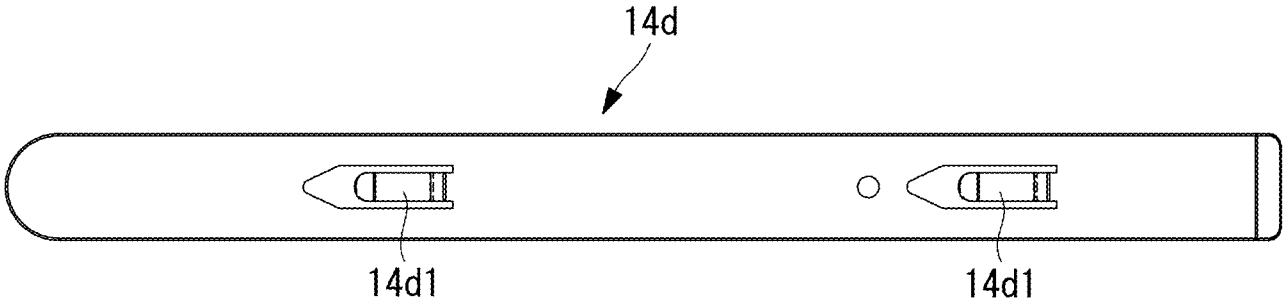
FIG. 13A is a plan view illustrating an extension part of a lifting plate.
Figure 13B:
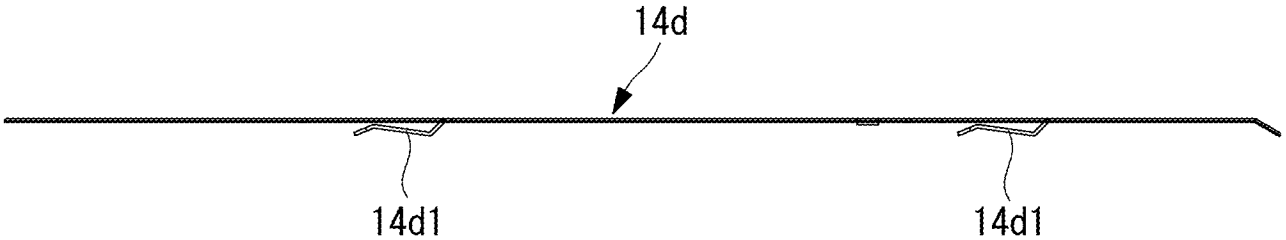
FIG. 13B is a side view illustrating an extension part of a lifting plate.
Figure 14:
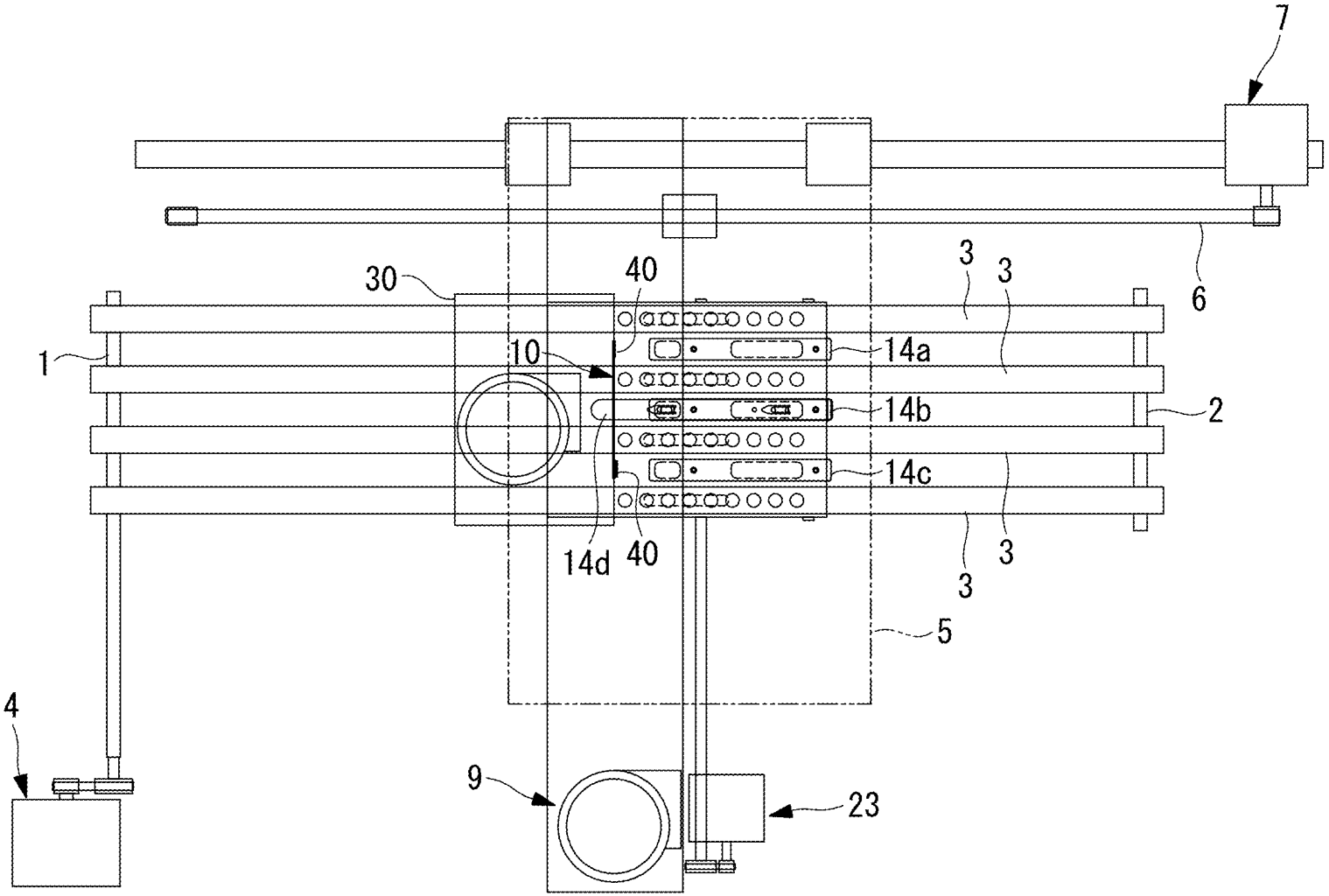
FIG. 14 is a plan view of a sheet feeding apparatus illustrating a state where an extension part is attached to a lifting plate.

If the length of the center lifting plate 14*b* is extended to the abutment plate 40 side as with the first embodiment, an extension part 14*d* as illustrated in FIG. 13A and FIG. 13B may be attached to the center lifting plate 14*b*. FIG. 14 illustrates a state where the extension part 14*d* is attached to the center lifting plate 14*b*. As illustrated in FIG. 14, because the extension part 14*d* is attached, the lifting plate 14*b* can be extended downstream from the abutment plate 40 in the conveyance direction.

As illustrated in FIG. 13A and FIG. 13B, the extension part 14*d* is a plate material having substantially the same width as the lifting plates 14*a*, 14*b*, and 14*c*. The extension part 14*d* has a thickness of about 0.5 mm, for example, and is made of a stainless steel. Clip parts 14*d*1 formed by bending are provided to two positions in the longitudinal direction of the extension part 14*d*.

As illustrated in FIG. 14, the clip parts 14*d*1 are inserted in holes formed in the center lifting plate 14*b* and then slid in the longitudinal direction, and thereby, the extension part 14*d* is fixed to the lifting plate 14*b*.

Note that the configuration of extending the lifting plate 14*b* by using the extension part 14*d* can also be applied to the first embodiment.

According to the present embodiment, in addition to the effects and advantages of the first embodiment, the following effects and advantages are achieved.

Since the abutment plates 40 are provided between the endless conveying belts 3 and/or to the side of the endless conveying belts 3, the abutment plates 40 do not come into contact with and slide on the endless conveying belts 3. This can reduce wear of the abutment plates 40.

Since the abutment plate 40 has an elastic plate-like member and the lower edge 40*b* of the tip 40*a* that is a free end abuts against a sheet, the abutment plate 40 can bend with elastic force when the lower edge 40*b* abuts against the sheet. Accordingly, suitable contact force can be applied to the sheet.

Since the upper surface 42*a* with which the lower edge 40*b* of the abutment plate 40 comes into contact is provided on the bearing plate 42 and the upper surface 42*a* has the same height as the conveying surfaces of the endless conveying belts 3, a sheet traveling on the conveying surfaces can be smoothly conveyed without deformation.

The guide plate 44 is provided upstream of the abutment plate 40, and the leading end of a sheet is guided along the slope part 44*a* of the guide plate 44. This ensures that the leading end of a sheet can be directed to the tip 40*a* of the abutment plate 40.

The slope part 44*a* can prevent a sheet from being turned up when the leading end of the sheet comes into contact with the abutment plate 40. Further, even when a turned-up sheet comes in, such turning up can be suppressed by the slope part 44*a*.

The stopper 44*b* is provided to the guide plate 44, and the abutment plate 40 collides with the stopper 44*b* when elastically deformed to the guide plate 44 side. This can restrict excessive deformation of the abutment plate 40. For example, when a sheet is pulled out in a direction opposite to the conveyance direction (pulled out to the guide plate 44 side) in a case of paper jam, the tip 40*a* of the abutment plate 40 is also deformed to the guide plate 44 side together with the sheet. The excessive deformation of the abutment plate 40 at this time can be suppressed by the stopper 44*b*.

Since the extension part 14*d* is detachable from the existing lifting plate 14*b*, the length of the lifting plate 14*b* can be changed if necessary.

Note that, in each embodiment described above, when the sheet loading amount is larger than a predetermined value, separating air may be blown off from the air blow-off unit 30 (see FIG. 1) while the lifting plates 14*a*, 14*b*, and 14*c* are vertically moved multiple times.

What is claimed is:

1. A sheet feeding apparatus comprising:

a plurality of conveying belts that convey an uppermost or lowermost sheet of a sheet stack placed on a conveying surface of the conveying belts in a feed out direction and in which a plurality of airflow holes is formed;

a suction unit that is arranged on a back surface side, which is the opposite side of the conveying surface of the conveying belts, and in which a first intake hole that sucks the sheet via the airflow holes and a second intake hole that sucks the sheet and provided between the plurality of conveying belts are formed;

at least one lifting plate that reciprocates between a first position at which the lifting plate projects out in a sheet accumulation direction with respect to the conveying surface and a second position located at the same height position as the conveying surface or on the back surface side with respect to the conveying surface, opens the second intake hole formed in the suction unit when the lifting plate is at the first position, and closes the second intake hole when the lifting plate is at the second position, the lifting plate being provided between the plurality of conveying belts; and a control unit that controls movement of the lifting plate, wherein the control unit is configured to move the lifting plate from the second position to the first position such that opening of the second intake hole reduces suction force of the first intake hole via the airflow holes when the uppermost or lowermost sheet is being conveyed.

2. A non-transitory computer readable storage medium storing a control program of a sheet feeding apparatus that causes a computer to function as the sheet feeding apparatus according to claim 1.

3. The sheet feeding apparatus according to claim 1, wherein the lifting plate is configured to separate sheets in the sheet stack from the conveying surface of the conveying belts.

4. The sheet feeding apparatus according to claim 3, wherein when a sheet is separated from the conveying surface of the conveying belts the sheet deforms and facilitates separation of the sheet from a next sheet in the sheet stack.

5. A sheet feeding apparatus comprising:

at least one conveying belt that conveys an uppermost or lowermost sheet of a sheet stack placed on a conveying surface of the conveying belt in a feed out direction and in which a plurality of airflow holes is formed;

a suction unit that is arranged on a back surface side, which is the opposite side of the conveying surface of the conveying belt, and in which a first intake hole that sucks the sheet via the airflow holes is formed;

at least one lifting plate that reciprocates between a first position located in a sheet accumulation direction with respect to the conveying surface and a second position located at the same height position as the conveying surface or on the back surface side with respect to the conveying surface, opens a second intake hole, which is different from the first intake hole, formed in the suction unit when the lifting plate is at the first position, and closes the second intake hole when the lifting plate is at the second position; and a control unit that controls movement of the lifting plate, wherein the control unit moves the lifting plate from the second position to the first position when the uppermost or lowermost sheet is being conveyed, wherein the conveying belt is formed of a plurality of conveying belts, and the conveying belts are provided in parallel spaced apart from each other by a predetermined gap in a width direction orthogonal to the feed out direction, and wherein the lifting plate is formed of a plurality of lifting plates, and the lifting plates are provided between the conveying belts adjacent to each other and/or to a side of the conveying belts.

6. The sheet feeding apparatus according to claim 5, wherein the plurality of conveying belts and the plurality of lifting plates are provided symmetrically about the center of the width direction orthogonal to the feed out direction of the sheet.

7. A sheet feeding apparatus comprising:

at least one conveying belt that conveys an uppermost or lowermost sheet of a sheet stack placed on a conveying surface of the conveying belt in a feed out direction and in which a plurality of airflow holes is formed;

a suction unit that is arranged on a back surface side, which is the opposite side of the conveying surface of the conveying belt, and in which a first intake hole that sucks the sheet via the airflow holes is formed;

at least one lifting plate that reciprocates between a first position located in a sheet accumulation direction with respect to the conveying surface and a second position located at the same height position as the conveying surface or on the back surface side with respect to the conveying surface, opens a second intake hole, which is different from the first intake hole, formed in the suction unit when the lifting plate is at the first position, and closes the second intake hole when the lifting plate is at the second position;

a control unit that controls movement of the lifting plate; and discharge rollers that grip a leading end of a sheet conveyed from the conveying belt and discharge the sheet, wherein the control unit moves the lifting plate from the second position to the first position when the uppermost or lowermost sheet is being conveyed, and wherein the control unit moves the lifting plate from the second position to the first position when the discharge rollers grip a leading end of a sheet conveyed from the conveying belt.

8. The sheet feeding apparatus according to claim 7, wherein an abutment member that abuts against the leading end of the sheet is provided upstream from the discharge rollers in the feed out direction.

9. The sheet feeding apparatus according to claim 8, wherein the conveying belt is formed of a plurality of conveying belts, and the conveying belts are provided in parallel spaced apart from each other by a predetermined gap in a width direction orthogonal to the feed out direction, and wherein the abutment member is provided between the conveying belts adjacent each other and/or to a side of the conveying belts, and a tip, which is a free end, of the abutment member is formed of an elastic plate member that abuts against a sheet.

10. The sheet feeding apparatus according to claim 9, wherein at a position facing the tip of the abutment member, a contact surface with which the tip contacts is provided, and wherein the contact surface has the same height as the conveying surface.

11. The sheet feeding apparatus according to claim 9, further comprising a guide plate having a slope part that guides a sheet to the tip of the abutment member.

12. The sheet feeding apparatus according to claim 11, wherein the guide plate comprises a stopper that has a gap between the abutment member and the stopper and collides with the abutment member when the abutment member is elastically deformed to the guide plate side.

13. The sheet feeding apparatus according to claim 8, wherein the abutment member is a retard roller provided so as to be pushed against the conveying belt.

14. The sheet feeding apparatus according to claim 8, wherein at least one of the lifting plates comprises an extension part provided extending to a position corresponding to the abutment member or extending downstream of the abutment member in the feed out direction.

15. The sheet feeding apparatus according to claim 14, wherein the extension part is detachable from the existing lifting plate.

16. A control method of a sheet feeding apparatus comprising:

a plurality of conveying belts that convey an uppermost or lowermost sheet of a sheet stack placed on a conveying surface of the conveying belts in a feed out direction and in which a plurality of airflow holes is formed, a suction unit that is arranged on a back surface side, which is the opposite side of the conveying surface of the conveying belts, and in which a first intake hole that sucks the sheet via the airflow holes and a second intake hole that sucks the sheet and provided between the plurality of conveying belts are is formed, and a lifting plate that reciprocates between a first position at which the lifting plate projects out in a sheet accumulation direction with respect to the conveying surface and a second position located at the same height position as the conveying surface or on the back surface side with respect to the conveying surface, opens the second intake hole formed in the suction unit when the lifting plate is at the first position, and closes the second intake hole when the lifting plate is at the second position, the lifting plate being provided between the plurality of conveying belts, wherein the control method comprises moving the lifting plate from the second position to the first position such that the opening of the second intake hole reduces suction force of the first intake hole via the airflow holes when the uppermost or lowermost sheet is being conveyed.

* * * * *